US007279199B2

(12) United States Patent
Nojima et al.

(10) Patent No.: US 7,279,199 B2
(45) Date of Patent: Oct. 9, 2007

(54) METHOD OF PRODUCING INKJET RECORDING SHEET UTILIZING SLOT NOZZLE SPRAY DEVICE

(75) Inventors: Takahiko Nojima, Hachioji (JP); Yosuke Sone, Akishima (JP); Shigeru Kojima, Hachioji (JP)

(73) Assignee: Konica Minolta Photo Imaging, Inc. (JP)

( * ) Notice: Subject to any disclaimer, the term of this patent is extended or adjusted under 35 U.S.C. 154(b) by 0 days.

(21) Appl. No.: 11/180,995

(22) Filed: Jul. 12, 2005

(65) Prior Publication Data

US 2006/0019042 A1 Jan. 26, 2006

(30) Foreign Application Priority Data

Jul. 20, 2004 (JP) ..... 2004-211342

(51) Int. Cl.
*B05D 5/04* (2006.01)
*B05D 1/02* (2006.01)
*B05D 1/38* (2006.01)

(52) U.S. Cl. ..... 427/407.1; 427/411; 427/412.1; 427/419.2; 427/419.5

(58) Field of Classification Search ..... 427/407.1
See application file for complete search history.

(56) References Cited

U.S. PATENT DOCUMENTS

| | | | |
|---|---|---|---|
| 5,364,702 | A | 11/1994 | Idei et al. |
| 6,455,132 | B1 | 9/2002 | Aurenty et al. |
| 2003/0197758 | A1 | 10/2003 | Susaki et al. |

FOREIGN PATENT DOCUMENTS

| | | | |
|---|---|---|---|
| DE | 40 22 008 | A1 | 1/1991 |
| EP | 0 355 752 | | 2/1990 |
| EP | 0 355 752 | A2 * | 2/1990 |
| JP | 10259332 | | 9/1998 |
| JP | 11-115308 | | 4/1999 |
| JP | 11-192777 | | 7/1999 |
| JP | 11286163 | | 10/1999 |
| JP | 2001354880 | | 12/2001 |
| JP | 2002-331745 | | 11/2002 |
| JP | 2003080839 | | 3/2003 |
| JP | 2003312131 | | 11/2003 |
| JP | 2003326832 | | 11/2003 |
| JP | 2004-000906 | | 1/2004 |

OTHER PUBLICATIONS

European Search Report for appl. No. 05106471.5-2304, mailed Aug. 16, 2005, 3 pgs.

* cited by examiner

*Primary Examiner*—William Phillip Fletcher, III
(74) *Attorney, Agent, or Firm*—Squire, Sanders & Dempsey L.L.P.

(57) ABSTRACT

A method of producing an ink-jet recording sheet containing the steps of: (a) coating a water-based coating composition A to form a layer on a non-absorptive support, the coating composition A containing a hydrophilic binder and inorganic microparticles having an average particle diameter of primary particles of not more than 30 nm, (b) drying the coated layer so as to form a porous ink absorptive layer, and (c) applying a water-based coating composition B on the porous ink absorptive layer across a direction perpendicular to a conveying direction of the non-absorptive support employing a slot nozzle spray device, the slot nozzle spray device having: (i) a coating nozzle for supplying the water-based coating composition B; and (ii) a gas nozzle for ejecting a gas to an aperture portion of the coating nozzle, wherein the water-based coating composition B has a dynamic surface tension of 20 to 55 mN/m.

3 Claims, 8 Drawing Sheets

METHOD OF PRODUCING INKJET RECORDING SHEET UTILIZING SLOT NOZZLE SPRAY DEVICE

This application is based on Japanese Patent Application No. 2004-211342 filed on Jul. 20, 2004 in Japanese Patent Office, the entire content of which is hereby incorporated by reference.

TECHNICAL FIELD

The present invention relates to a production method of novel ink-jet recording sheet.

BACKGROUND

To the present, known are various methods to apply a liquid coating composition (hereinafter occasionally referred simply to as a coating composition) onto a support. For example, proposed as methods to precisely apply a liquid coating composition onto a conveyed long belt-shaped support (hereinafter occasionally referred simply to as a support) are various methods as described in Edward Cohen and Edgar Gutoff, "MODERN COATING AND DRYING TECHNOLOGY". For example, known are a dip coating method, a blade coating method, an air knife coating method, a wire bar coating method, a gravure coating method, a reverse coating method, an extrusion coating method, a slide bead coating method, and a curtain coating method. Further, in these coating methods, in order to obtain a dried layer thickness which is highly uniform across the width of the support, coating is performed while paying special attention to the coating thickness accuracy and uniformity (after coating and prior to drying) during coating.

Of these coating methods, a coating apparatus, having flow controlling type die, is capable of achieving high coating rate, thin layers, and simultaneous multilayer coating. Due to such characteristics, the above apparatus is widely used as a coating apparatus for light-sensitive photographic materials, ink-jet recording materials, and magnetic recording materials.

As a preferred example, the slide bead coating apparatus and the extrusion coating apparatus, which are proposed in U.S. Pat. No. 2,761,791 by Russell et al. have been widely used. Further, the curtain coating apparatus is also a flow controlling type coating apparatus having a die and is similarly widely employed.

For example, in the case of the above slide bead coating apparatus, a shaped liquid coating composition, called a bead is formed between the tip of the coating apparatus and the conveyed support, and coating is performed via the bead. Further, in the case of a curtain coating apparatus, a liquid coating composition shaped as a curtain falls freely and coating is performed in such a manner that a support is positioned at the falling front. These are markedly advantageous to obtain a highly accurate and uniformly thick dried layer.

However, during coating employing these coating apparatuses having a die, due to their principle, the coating apparatus and the support are continuously connected via the liquid coating composition, such as a bead or a curtain film. In order to form a uniformly thick coating film on a support, it is essential that a liquid coating composition continuously flows at a constant rate and no discontinuity is allowed to occur. Namely, in order to continuously form a coated film and to maintain a highly accurate coating thickness, the liquid coating composition is required in an amount greater than the specified amount. Accordingly, an excessive decrease in the amount of the liquid coating composition ejected from a coating apparatus results in difficulty to achieve the target to obtain uniform thickness.

Due to that, in the case of a small amount of elusion per coating layer, namely in the case in which a layer of a very thin wet thickness (for example, at about 1—about 50 μm), prior to drying after coating a liquid coating composition is formed, it is required to increase the solvent amount of the liquid coating composition to increase its total volume. Specifically, in cases in which the viscosity of liquid coating compositions is low, the coated composition flows on a support resulting in an unstable coating layer, whereby it is required to further increase the amount of the liquid coating composition.

However, in view of production efficiency, an increase in the solvent amount is not preferred due to an increase in load (being a drying load) to dry the coating by evaporating the excessive solvents after coating. Further, in cases in which another constituting layer is present below the aforesaid coating layer, the liquid coating composition of the aforesaid coating layer excessively penetrates and diffuses into the upper constituting layer, occasionally resulting in adverse effects.

Consequently, a coating method is demanded which provides a thin layer which achieves higher accuracy in a coating layer thickness, less drying load, and higher production efficiency.

There are various coating products which require to provide such a uniform thin layer of a high accuracy on a constituting layer. For example, listed are the porous ink-jet recording sheet described below.

Recording sheet used for ink-jet recording include one in which the ink absorptive layer is paper itself such as plain paper, another one in which an ink absorptive layer is coated onto a support such as coated paper, which also works as an absorbent, or still another one in which an ink absorptive layer is applied onto a non-absorptive support such as a resin coated paper or a polyester film.

Of these, recording sheet in which an ink absorptive layer is applied onto a non-absorptive support are preferably employed for output which requires a feel of high quality such as a feel of gloss, a feel of luster, or feel of depth of silver halide photography due to reasons in which the support surface exhibits high smoothness and minimal waviness. Further, employed as glossy type recording sheet are swelling type recording sheet in which water-soluble binders such as polyvinylpyrrolidone and polyvinyl alcohol are applied onto a non-absorptive support as an ink absorptive layer, and so-called porous rerecording sheet in which a minute porous structure is formed in an ink absorptive layer employing pigments, or pigments, and binders and ink is absorbed into the resulting voids.

In a porous recording sheet, an ink absorptive porous layer having the above porous structure is formed mainly by employing hydrophilic binders and microparticles (hereinafter it is also called as microparticles). Known as microparticles are inorganic or organic ones, while inorganic microparticles are commonly employed which are minuter and glossier. By employing hydrophilic binders in a relatively small amount with respect to the above microparticles, minute voids are formed among the microparticles, whereby a porous ink absorptive layer is prepared.

Various characteristics are demanded for the above porous ink absorptive layer, and in order to improve these various characteristics, it is proposed to use each of the additives described below.

Listed are:

1: in order to achieve high color forming efficiency and desired glossiness, stable microparticles which form porosity of at most approximately 0.1 μm, 2: low swelling hydrophilic binders which exhibit high minute particle capturing power and result in no decrease in the ink absorption rate, 3: cross-linking agents to enhance the ink absorption rate and to improve the waterfastness of layers, 4: surface active agents and hydrophilic polymers distributed over the surface to achieve optimal dot diameter, 5: cationic fixing agents and multivalent metal compounds to minimize dye bleeding and to enhance waterfastness, 6: anti-discoloring agents to minimize discoloration of dye images due to ambient light and oxidizing gases 7: optical brightening agents and color tone controlling agents (reddening agents and bluing agents) to improve white backgrounds, 8: matting agents and slipping agents to improve slipping properties of the surface, 9: various types of oil components, latex particles, or water-soluble plasticizers to provide the porous ink absorptive layers with flexibility, 10: various inorganic salts (multivalent metal salts) to minimize dye bleeding and enhance waterfastness and weather resistance, and 11: acids and alkalis which control the pH of the surface of the porous ink absorptive layer.

However, when additives which are employed to achieve the various above targets are added to liquid coating compositions which form the porous ink absorptive layer, in many cases, additives exhibit various types of limitation in view of stability of the production processes.

As one of the methods to overcome the above drawbacks, a porous ink absorptive layer liquid coating composition, in which the above additives are not incorporated, is initially applied as a constituting layer onto a support, and prior to reaching the falling-rate drying, a liquid coating composition incorporating the above additives is applied onto the above constituting layer, namely a so-called overcoat layer is provided (refer, for example, to Patent Documents 1 and 2). It is thought that the above additives incorporated in the liquid coating composition appropriately penetrate into the previously provided constituting layer (for example, a porous ink absorptive layer) and exhibit desired functions without causing the above drawbacks, namely working as a function providing compound. Originally, the overcoat layer is employed so that specific function providing compounds are impregnated into the porous ink absorptive layer. Consequently, the thickness of the overcoat layer may be quite thin, and is rather preferably very thin. Further, ink-jet recording sheet are proposed (refer, for example, to Patent Document 3) in which a water-based coating composition which incorporates hydrophilic binders and microparticles is coated and after the water volume in the resulting coating reaches that which is equal to or less than the void volume of the porous layer after drying, a solution incorporating additives is overcoated via on-line.

However, when two layers, consisting of a constituting layer and an overcoat layer, are provided employing the following two processes, problems occur in which production cost increases markedly. The above constituting layer is initially coated and dried, and the resulting coating is temporarily wound in a roll. Thereafter, the coating is unwound and the above overcoat layer is applied thereon. Further, when time is elapsed after forming the constituting layer, problems tend to occur in which stability of product quality is degraded due to temperature hysterisis as well as time fluctuation, and coating mottle tends to occur during providing the overcoat layer.

As a result, coating the overcoat layer supplies a large amount of solvents (water and organic solvents) onto the surface of the ink absorptive layer, whereby cost increases due to extension of drying time and length of the drying zone, and when drying capacity is limited, the coating rate inevitably decreases. Further, by coating an overcoat layer of excessive thickness, the degree of diffusion and penetration into the ink absorptive layer during the period until drying increases, and it takes time to achieve complete drying. As a result, effects result so that additives are directly incorporated in the porous ink layer liquid coating composition, whereby it is not possible of the overcoat layer to sufficiently exhibit the desired advantages.

In order to overcome the above drawbacks, the following coating method is proposed (refer, for example, to Patent Document 4). While conveying a medium to be coated, by employing a slot nozzle spray device, fitted with a liquid coating composition nozzle which supplies a liquid coating composition and a gas ejecting nozzle which is near the aperture end of the liquid coating composition nozzle over the coating width in the direction crossing with the conveying direction of the medium to be coated, gas is allowed to collide with the liquid coating composition to form droplets in the form of spray, whereby the liquid coating composition is applied onto the medium to be coated.

The inventors of the present invention further conducted detailed investigation of the method described in Patent Document 4. As a result, it was discovered that the above method made it possible to realize a thin uniform thickness layer coating of high accuracy, high rate and low drying load, and exhibited various excellent characteristics of recording sheet, such as coating uniformity, and liquid coating composition stability. However, it was also discovered that depending on specified coating conditions, particle-shaped mottle due to liquid coating composition droplets, longitudinal streaking mottle or spot-shaped mottle due to scattering of coarse droplets tended to occur. In order to overcome these drawbacks, it is necessary to optimize physical properties of the ejected overcoat liquid coating composition, the shape of the employed coating apparatus, and the surface treatments of the specified positions.

(Patent Document 1) Japanese Patent Publication for Public Inspection (hereinafter referred to as JP-A) No. 11-115308 (claims)

(Patent Document 2) JP-A No. 11-192777 (claims)

(Patent Document 3) JP-A No. 2002-331745 (claims)

(Patent Document 4) JP-A No. 2004-906 (claims)

SUMMARY

In view of the above problems, the present invention was achieved. An object of the present invention is to provide a production method of ink-jet recording sheet, which minimizes formation of mottled streaking and coating defects, and results in excellent coating uniformity.

The above object of the present invention is achieved employing the following embodiments.

(1) An aspect of the present invention includes a method of producing an ink-jet recording sheet comprising the steps of:

(a) coating a water-based coating composition A to form a layer on a non-absorptive support, the coating composition A containing a hydrophilic binder and inorganic microparticles having an average particle diameter of primary particles of not more than 30 nm, (b) drying the coated layer so as to form a porous ink absorptive layer, and (c) applying a water-based coating composition B on the porous ink absorptive layer across a direction perpendicular to a conveying direction of the non-absorptive support employing a slot nozzle spray device, the slot nozzle spray device having:

(i) a coating nozzle for supplying the water-based coating composition B; and (ii) a gas nozzle for ejecting a gas to an aperture end portion of the coating nozzle, wherein the water-based coating composition B has a dynamic surface tension of 20 to 55 mN/m, and the water-based coating composition B contains an acetylene glycol compound or an acetylene alcohol compound.

(2) Another aspect of the present invention includes a method of producing an ink-jet recording sheet of the above-described item 1, wherein at least one of the group consisting of:

(i) an aperture surface of the slot nozzle spray device;

(ii) a gas channel wall of the gas nozzle of the slot spray nozzle device; and (iii) a coating composition channel wall of the coating nozzle of the slot spray nozzle device, is subjected to surface water-repellent finishing.

(3) Another aspect of the present invention includes a method of producing an ink-jet recording sheet of the above-described item 1, wherein the water-based coating composition B further contains a compound which is capable of changing a property of the ink absorptive layer.

(4) Another aspect of the present invention includes a method of producing an ink-jet recording sheet of the above-described item 3, wherein the compound is selected from the group consisting of:

(i) a cross-linking agent of the hydrophilic binder;

(ii) an image stabilizer;

(iii) a water-soluble multivalent metal compound;

(iv) a mordant; and (v) a pH controlling agent.

According to the present invention, it is possible to provide a production method of ink-jet recording sheet, which minimizes generation of streaking mottle and other coating problems, and results in excellent coating uniformity.

DESCRIPTION OF THE PREFERRED EMBODIMENTS

Figure 1:
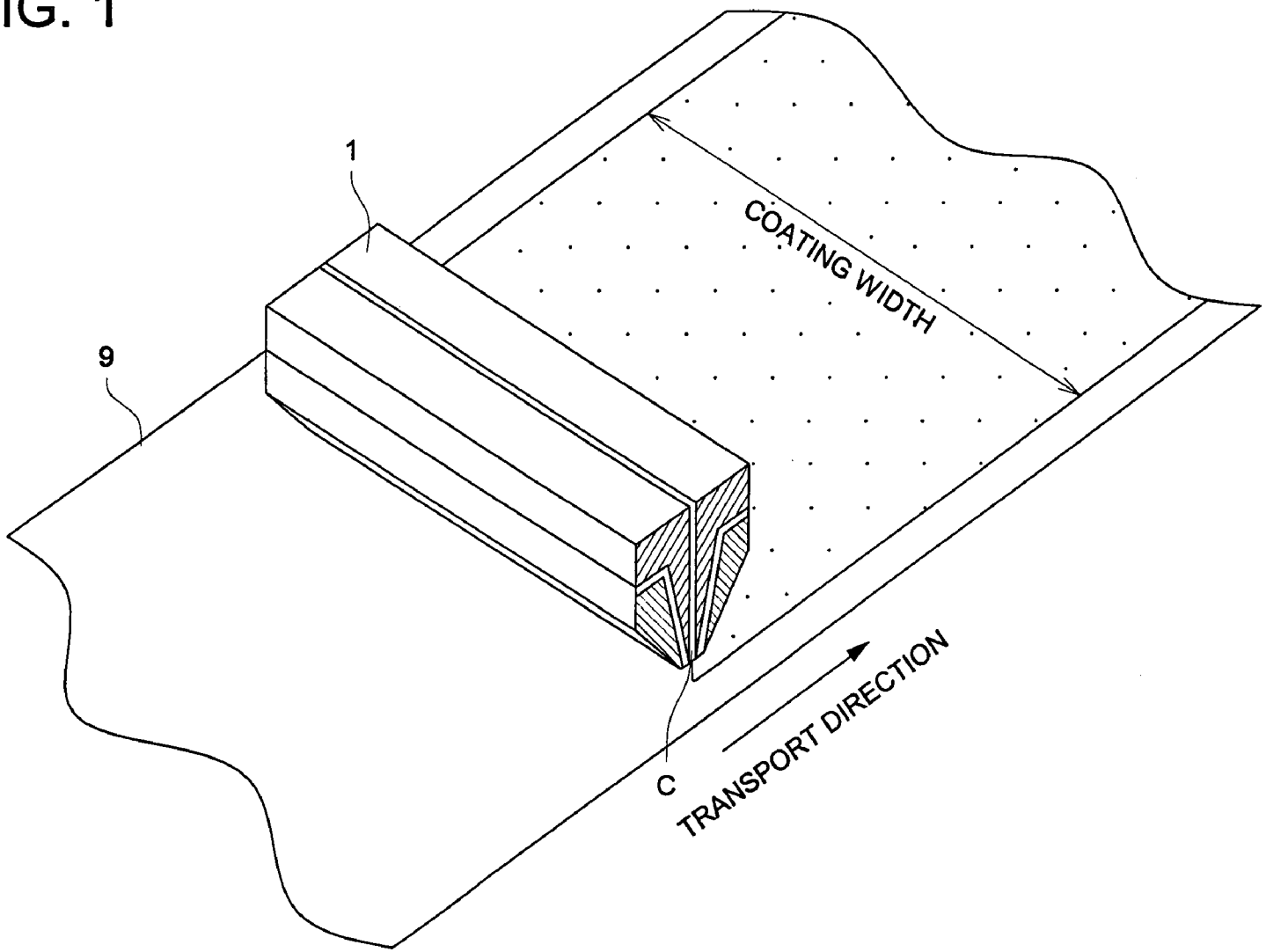
FIG. 1 is a schematic view to describe the coating method of the present invention.

The most preferred embodiment to practice the present invention will now be detailed.

The inventors of the present invention conducted diligent investigation of coating stability while using a slot nozzle spray device which conveys a medium to be coated and has a liquid coating composition nozzle which supplies a liquid coating composition across the coating width in the direction crossing with the conveying direction of said medium to be coated, as well as a gas nozzle which is near the aperture end of the liquid coating composition nozzle and ejects gas. As a result, the following was discovered. In a production method of an ink-jet recording medium, which had a series of processes in which after water-based coating composition incorporating inorganic microparticle of an average primary particle diameter of at most 30 nm as well as a hydrophilic binder was applied onto a non-absorptive support and a porous ink absorptive layer was formed by drying the coating formed by said water-based coating composition A, water-based coating composition B was applied onto said porous ink absorptive layer, employing a slot nozzle spray device having a liquid coating composition supplying liquid coating composition nozzle and a gas ejecting nozzle which was near the aperture end of said liquid coating composition nozzle across the coating width in the direction crossing the conveying direction of said non-absorptive support, by specifying the dynamic surface tension of said water-based coating composition B in the range of 20-55 mN, it was possible to realize a production method of an ink recording medium which minimized mottled streaking and other coating problems and resulted in excellent coating uniformity (uniformity across the width, and edge coatability).

Further, in addition to conditions of the present invention specified above, by applying a water-repellent surface treatment to at least one selected from the aperture surface constituting the slot nozzle spray device, the gas channel wall of the above gas nozzle, and the liquid channel wall of the above liquid coating composition nozzle, the above coatability is enhanced whereby more stable uniform coating was obtained. It is assumed that by applying a water-repellent treatment to the specified portion of the slot nozzle spray device, droplets sprayed from the nozzle are readily separated, whereby it is possible to spray more uniform and minute droplets.

The present invention will now be detailed.

In the production method of the ink-jet recording sheet of the present invention (hereinafter sometimes referred to as the production method), as noted above, in a production method of the ink-jet recording sheet, which consists of a series of processes in which after water-based coating composition A is applied onto a non-absorptive support and a porous ink absorptive layer is formed by drying the coating formed by aforesaid water-based coating composition A, water-based coating composition B is applied onto the aforesaid porous ink absorptive layer, employing a slot nozzle spray device, having a liquid coating composition supplying liquid coating composition nozzle and a gas ejecting nozzle which is near the aperture end of said liquid coating composition nozzle across the coating width in the direction crossing the conveying direction of said non-absorptive support, wherein the dynamic surface tension (hereinafter sometimes referred to as DST) is specified preferably in the range of 20-55 mN/m, more preferably in the range of 20-50 mN/m and still preferably in the range of 20-40 mN/m.

Generally, when the surface of a solution is newly formed, the resulting surface tension takes a definite time to reach equilibrium. In the present invention, when droplets of liquid coating composition B are ejected from the liquid coating composition nozzle section of a slot nozzle spray device and form their new surface, for example in the case of an increase in the specific surface area, the resulting surface tension changes over time depending on the orientation rate of surface active agents, the surface orientation strength due to difference of surface active agents, and evaporation of solvents in the surface layer. It is possible to determine the surface tension in such a non-equilibrium state as a dynamic surface tension. In the present invention, this determined surface tension is defined as dynamic surface tension.

Employed as methods to determine the dynamic surface tension may be any of those commonly known in the art. Examples include a meniscus method, a dripping method, a γ/A curve method, a vibration jet method, a maximum bulb pressure method, and a curtain coater method (J. Fluid Mech. (1981), Vol. 112, pages 443-458). In the present invention, shown are dynamic surface tension values determined by employing the maximum bubble pressure method.

Listed as specific examples of a surface tension balance based on the maximum bubble pressure method may be BP2 BUBBLE PRESSURE DYNAMIC SURFACE TENSION BALANCE, produced by Kruss Co. and DYNAMIC SURFACE TENSION METER TYPE BP-D4, produced by Kyowa Interface Science Co., Ltd.

It is assumed that effects of the present invention are exhibited in such a manner that by lowering the dynamic surface tension of water-based coating composition B, which is applied onto a support employing a slot nozzle spray device, to the value specified by the present invention, the liquid coating composition is uniformly spread within the flow channel of the liquid nozzles upon being wetted and the size of droplets is further minimized.

Methods to control the dynamic surface tension of water-based coating composition B, according to the present invention, to the value specified by the present invention are investigated. And it was found that it is markedly effective to use the acetylene glycol compounds as well as the acetylene alcohol compounds described below. In addition, it is possible to use surface active agents which exhibit some hydrophobicity, as well as water-soluble organic solvents which exhibit relatively low surface tension.

In the production method of the present invention, it is preferable that water-based coating composition B, according to the present invention, incorporates either acetylene glycol compounds or acetylene alcohol compounds.

Acetylene glycol compounds as well as acetylene alcohol compounds, which are usable in the present invention, are not particularly limited. However, preferred are the acetylene glycol compounds and acetylene alcohol compounds, described below.

Acetylene glycol compounds and acetylene alcohol compounds employed in the present invention are those represented by General Formulas (1), (2), and (3), described below.

General Formula (1)

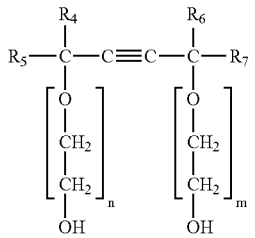

In General Formula (1), $R_4$ and $R_6$ each represent an alkyl group having 1-3 carbon atoms; $R_5$ and $R_7$ each represent an alkyl group having 1-20 carbon atoms or an allyl group; each of $R_4$ and $R_6$ is preferably a methyl group, while each of $R_5$ and $R_7$ is preferably an isobutyl group; m and n each represent an integer of 0-40; and the sum of m and n is preferably 2-30, but is more preferably 2-10.

General Formula (2)

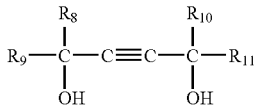

In General Formula (2) $R_8$ and $R_{10}$ each represent an alkyl group having 1-3 carbon atoms; $R_9$ and $R_{11}$ each represent an alkyl group having 1-20 carbon atoms or an allyl group; each of $R_8$ and $R_{10}$ is preferably a methyl group, while each of $R_9$ and $R_{11}$ is preferably an ethyl group or an isobutyl group.

General Formula (3)

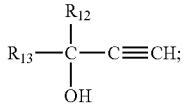

In General Formula (3) $R_{12}$ represents an alkyl group having 1-3 carbon atoms; $R_{13}$ represents an alkyl group having 1-20 carbon atoms or an allyl group; and $R_{12}$ is preferably a methyl group, while $R_{13}$ is preferably an isobutyl group.

It is preferable that acetylene glycol compounds and acetylene alcohol compounds according to the present invention have a triple bond in the molecule and a hydroxyl group as-well as an alkyl group on the adjacent carbon atom, and exhibit a right/left symmetrical structure with respect to the triple bond.

Acetylene glycol compounds and acetylene alcohol compounds according to the present invention are nonionic and are characterized in that by the combination of the triple bond and the hydroxyl group adjacent to it, electron density is markedly increased, while the central portion of the molecule exhibits strong polarity. These compounds exhibit different characteristics from other common nonionic compounds, and when the triple bond is changed to a double bond or a single bond, it is not possible to achieve the desirable effects of the present invention.

Of the compounds represented by above General Formulas (1)-(3), compounds which are more preferably usable in the present invention are acetylene glycol compounds represented by General Formula (1).

Acetylene glycol compounds and acetylene alcohol compounds employed in the present invention are available as commercial products. For example, listed are SURFINOL and OLFIN, produced by Nissin Chemical Industry Co., Ltd. as well as ACETYLENOL, produced by Kawaken Fine Chemical Co., Ltd.

The content of the acetylene glycol compounds or the acetylene alcohol compounds according to the present invention is preferably 1-1,000 mg per $m^2$ of the recording sheet, but is more preferably 5-300 mg.

Incidentally, it is common knowledge that acetylene glycol compounds and acetylene alcohol compounds are typically employed in ink-jet recording sheet. For example, Japanese Registration Patent No. 3126128 and JP-A No. 11-286163 describe ink-jet sheets in which an ink receptive layer incorporating acetylene glycol, microparticles, and binders is provided on a non-absorptive paper support. Further, JP-A No. 2002-19279 discloses ink-jet recording sheet having a gloss-generating layer which is applied onto an ink absorptive layer incorporating ethylene oxide addition compounds of acetylene glycol on an absorptive paper support. Further, JP-A No. 2-551187 discloses recording materials, composed of a support, having thereon an ink retaining layer and an ink transport layer incorporating surface active agents, and acetylene glycol and/or alcohol. Further, JP-A No. 11-138978 discloses ink-jet recording sheet composed of a support having thereon an ink absorptive layer incorporating alumina hydrate, polyvinyl alcohol, and acetylene glycol. However, in the above patents, no description is found which allows the effects of the present invention to be sufficiently exhibited in such a manner that, in taking into account the problems of the present invention, the above compounds are added to water-based coating composition B employed in the spray nozzle device specified in the present invention, and the dynamic surface tension is thereby controlled.

Further, in the production method of the present invention, to enhance the solubility and stability of preferably employed above acetylene glycol compounds and acetylene alcohol compounds in water-based coating composition B, it is possible to simultaneously use dissolution aids such as cationic, anionic, and nonionic surface active agents.

In the production method the present invention, it is preferable that water-based coating composition B incorporates a function-providing compound to the porous ink absorptive layer. The function-providing compound is capable of changing a property of the ink absorptive layer and is one selected from the group consisting of a hydrophilic binder cross-linking agent, an image stabilizer, a water-soluble multivalent metal compound, a mordant and a pH controlling agent.

Listed as acids which are usable to lower the pH of the porous ink absorptive layer may, for example, be inorganic acids such as sulfuric acid, hydrochloric acid, or nitric acid, as well as organic acids such as citric acid, formic acid, acetic acid, phthalic acid, succinic acid, oxalic acid, or polyacrylic acid.

Listed as alkalis to increase the pH of the porous ink absorptive layer may, for example, be sodium hydroxide, potassium hydroxide, sodium carbonate, potassium carbonate, borax, sodium phosphate, calcium hydroxide, or organic amines.

The above pH controlling agents are particularly preferred when the pH of a porosity forming liquid coating composition differs from the layer pH.

The surface pH of the porous ink absorptive layer of recording sheet differs depending toward the kinds of ink. Commonly, however, waterfastness and bleeding resistance of dyes tend to be enhanced toward the acidic side, while lightfastness of the same tends to be improved on the higher pH side. Consequently, the optimal pH is chosen depending on the combination of used inks. The surface pH of the porous layer is preferably 3-7, but is most preferably 3.5-6.5. The surface pH, as described herein, refers to the value which is determined based on the measurement method of the surface pH of paper specified in J. TAPPI 49. Specifically, the pH refers to the value which is determined in such a manner that 50 μl of pure water (at a pH of 6.2-7.3) is dripped onto the surface of a recording medium and the pH of the resulting dripped water is determined employing a commercially available flat electrode.

The above function-providing compounds may be cross-linking agents of hydrophilic binders.

Employed as such cross-linking agents may be any of those known in the art. Preferred are the above-mentioned boric acids, zirconium salts, aluminum salts, and epoxy based cross-linking agents.

Employed as the above function-providing compounds may be image stabilizers (hereinafter sometimes referred to as anti-discoloring agents). The anti-discoloring agents retard discoloring due to light irradiation, as well as discoloring due to oxidizing gases such as active oxygen, $NO_x$, or $SO_x$.

Also employed as the above function-providing compounds may be cationic polymers.

Cationic polymers generally function as a fixing agent of dyes to enhance waterfastness and to minimize bleeding. Accordingly, it is preferable to previously incorporate them in a liquid coating composition to form a porous receptive layer. However, in cases in which their addition in the liquid coating composition causes problems, it is possible to supply them via an overcoating method. For example, in cases in which the viscosity of a liquid coating composition increases during standing due to the addition of the cationic polymers, or in cases in which color formation is improved in such a manner that the cationic polymers are appropriately distributed in the porous layer, it is preferable to supply them employing an overcoating method. When cationic polymers are supplied via the overcoating method, the supplied amount is in the range of about 0.5-about 5 g per $m^2$ of the recording medium.

The above function-providing compounds may be water-soluble multivalent metal compounds.

Generally, water-soluble multivalent metal compounds in liquid coating compositions containing inorganic microparticle tend to result in coagulation and thereby tend to. result in minute coating problems as well as a decrease in glossiness. Therefore, it is particularly preferable to supply them via the overcoating method.

Employed as such multivalent metal compounds are sulfates, chlorides, nitrates, and acetates of metal ions such as $Mg^{2+}$, $Ca^{2+}$, $Zn^{2+}$, $Zr^{2+}$, $Ni^{2+}$, $Al^{3+}$.

The above function-providing compounds may be employed individually or in combinations of at least two types. Specifically, it is possible to use an aqueous solution incorporating at least two anti-discoloring agents, a solution incorporating an anti-discoloring agent(s) as well as a cross-linking agent(s), and a solution incorporating an anti-discoloring agent(s) as well as a surface active agent(s). Further, it is possible to simultaneously use a cross-linking agent(s), a water-soluble multivalent metal compound(s), and an anti-discoloring agent(s).

Employed as solvents of the above function-providing agents may be water or mixed solutions of water with organic solvents, while it is particularly preferable to use water. Employed as preferred solvents are mixed solvents of only water with water-soluble low boiling point organic solvents (for example, methanol, ethanol, i-propanol, n-propanol, acetone, and methyl ethyl ketone). In cases in which water is mixed with water-soluble organic solvents, the content of water is preferably at least 50 percent by weight.

Water-soluble low boiling point organic solvents, as described herein, refer to organic solvents which are soluble in water in an amount of at least 10 percent by weight at room temperature and exhibit a boiling point of at most about 120° C.

Further employed as the above function-providing compounds may be mordants.

In the present invention, appropriately employed as mordants may be compounds containing an aluminum atom. The compounds containing an aluminum atom may be in the form of any of the single salts or double salts of inorganic or organic acids, organic metal compounds, and metal complexes. Of these, particularly preferred are polychlorinated aluminum compounds, polysulfuric acid aluminum compounds, and polysulfuric acid silicic acid aluminum compounds.

Polychlorinated aluminum compounds are represented by general formulas of $[Al_2(OH)_nCl_{6-n}]m$, and $[Al(OH)_3]n{\cdot}AlCl_3$. Examples include polychlorinated aluminum such as $[Al_6(OH)_{15}]^{3+}$, and $[Al(OH)_{20}]_{4+}$, or $[Al(OH)_{34}]^{5+}$, each of which is basic and stably incorporates high positive electric charge polynuclear condensation ions (polymer property) as an effective component.

Listed as commercially available products of polychlorinated aluminum compounds are, for example, polyhydroxide aluminum (Paho), produced by Asada Chemical Co., Ltd., polychlorinated aluminum (PAC), produced by Taki Chemical Co., Ltd., and PUCHELUM WT, produced by Rikengreen Co., Ltd. Further, polysulfuric acid aluminum compounds are represented by the general formula of $[AL_2(OH)_n(SO_4)_{6-n/2}]m$ (wherein $0<n<6$). Listed as the commercially available products is basic aluminum sulfate (AHS), produced by Asada Chemical Co., Ltd. Listed as a commercially available product of polysulfuric acid silicic acid aluminum compound is PASS, produced by Nippon Light Metal Co., Ltd.

Ink-jet recording sheet, to which the production method of the present invention can preferably be applied, are prepared in such a manner that water-based coating composition A incorporating inorganic microparticle of an average primary particle diameter of at most 30 nm and hydrophilic binders is applied onto a non-water absorptive support, and a porous ink absorptive layer is formed by drying the coating formed by aforesaid water-based coating composition.

Listed as inorganic microparticle usable in the present invention may, for example, be white inorganic pigments such as precipitated calcium carbonate, heavy calcium carbonate, magnesium carbonate, kaolin, talc, calcium sulfate, barium sulfate, titanium dioxide, zinc oxide, zinc hydroxide, zinc carbonate, hydrotalcite, aluminum silicate, diatomaceous earth, calcium silicate, synthetic non-crystalline silica, colloidal silica, alumina, colloidal alumina, pseudo-boehmite, aluminum hydroxide, lithopone, zeolite, or magnesium hydroxide. Further, these pigments may be employed individually or in combinations of several types.

In the present invention, in view of obtaining high quality prints employing ink-jet recording sheet, especially preferred as inorganic microparticle are alumina, pseudo-boehmite, colloidal silica, or minute silica particles synthesized by a gas phase method. Of these, most preferred are minute silica particles synthesized by a gas phase method. The silica synthesized by a gas phase method may be those of which surface is modified by Al. The content of Al of the gas phase method silica of which surface is modified by Al is preferably 0.05-5 percent in terms of weight ratio with respect to silica.

To achieve a structure having a large void ratio, the particle diameter of the above inorganic microparticle is featured to be at most 30 nm as an average primary particle diameter, and to enhance the transparency of the resulting layer, it is most preferably 3-10 nm.

The average diameter of the above minute inorganic particle is determined as follows. The cross-section and the surface of the porous material layer is observed employing an electron microscope, whereby the diameter of 100 randomly selected particles is determined. Subsequently, the simple average (being the number average) is obtained. Herein, each particle diameter is represented by the diameter of a circle which has the same area as the projective area of the particles.

Further, hydrophilic binders usable in the porous ink absorptive layer according to the present invention are not particularly limited, and examples include polyvinyl alcohol, gelatin, polyethylene oxide, polyvinylpyrrolidone, polyacrylic acid, polyacrylamide, polyurethane, dextran, dextrin, carrageenan (κ, ι, and λ), agar-agar, Pullulan, water-soluble polyvinyl butyral, hydroxyethyl cellulose, and carboxymethyl cellulose.

Particularly preferred as a hydrophilic binder is polyvinyl alcohol. Other than common polyvinyl alcohol obtained by hydrolyzing polyvinyl acetate, polyvinyl alcohol which is preferably employed in the present invention includes modified polyvinyl alcohol such as terminal cation-modified polyvinyl alcohol or anion-modified polyvinyl alcohol having an anionic group.

Polyvinyl alcohol of an average degree of polymerization of at least 1,000, which is prepared by hydrolyzing vinyl acetate, is preferably employed, but one at an average degree of polymerization of 1,500-5,000 is most preferably employed.

The saponification ratio is preferably 70-100 percent, but is most preferably 80-99.5 percent.

Cation-modified polyvinyl alcohol refers to one having any of the primary, secondary, and tertiary amino groups as well as a quaternary ammonium group on the main or side chain of the above polyvinyl alcohol, as described, for example, in JP-A No. 61-10483, and is prepared by saponifying a copolymer of vinyl acetate with ethylenic unsaturated monomers having a cationic group.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(3-dimethylaminopropyl)methacrylamide, hydroxyethyltrimethylammonium chloride, trimethyl-(2-methacrylamidopropyl) ammonium chloride, and N-(1,1-dimethyl-3-dimethylaminopropyl)acrylamide.

The ratio of cation-modifying group containing monomers is commonly 0.1-10 mol percent with respect to vinyl acetate, but is preferably 0.2-5 mol percent.

Listed as anion-modified polyvinyl alcohol are, for example, anionic groups containing polyvinyl alcohol, described in JP-A No. 1-206088, copolymers of vinyl alcohol with vinyl compounds having a water solubilizing group, described in JP-A Nos. 61-237681 and 63-307979, as well as modified polyvinyl alcohol having a water solubilizing group, described in JP-A No. 7-285265.

The added amount of inorganic microparticle employed in an ink absorptive layer largely depends on the required ink absorption capacity, the void ratio of the porous layer, the kinds of inorganic microparticle, and the kinds of hydrophilic binders, and is commonly 5-30 g per $m^2$ of the recording medium, but is preferably 10-25 g.

Further, the ratio of the inorganic microparticle and the hydrophilic binders employed in the ink absorptive layer is commonly 2:1-20:1, but is most preferably 3:1-10:1.

In view of preparing higher quality prints, supports usable in the present invention are non-water absorptive. Supports which are preferably employed in the present invention include a transparent polyester film, an opaque polyester film, an opaque polyolefin resinous film, and a paper support prepared by laminating both sides of the paper with polyolefin resins.

Paper supports prepared by laminating both sides of the paper with polyolefin resins will now be described.

Base paper employed for paper supports is produced employing wood pulp as a main raw material, and if desired, employing synthetic pulp such as polypropylene, or synthetic fibers such as nylon or polyester. As wood pulp, for example, any of LBKP, LBSP, NBKP, NBSP, LDP, NDP, LUKP, and NUKP may be employed. However, LBKP, NBSP, LBSP, NDP, and LDP having shorter fibers are preferably employed in a larger proportion. However, the ratio of LBSP or LDP is preferably from 10 to 70 percent by weight.

As the above pulp, chemical pulp (sulfate salt pulp and sulfite salt pulp) containing minimal impurities is preferably employed, and pulp, which has been subjected to a bleaching treatment to increase whiteness, is also beneficial.

Suitably incorporated into base paper may be sizing agents such as higher fatty acids and alkylketene dimers; white pigments such as calcium carbonate, talc, and titanium oxide; paper strength enhancing agents such as starch, polyacrylamide, and polyvinyl alcohol; optical brightening agents; moisture retaining agents such as polyethylene glycols; dispersing agents; and softeners such as quaternary ammonium.

The freeness of pulp used for paper making is preferably 200-500 ml under the specification of CSF, while in fiber length after beating, the sum of weight percent of 24 mesh residue and weight percent of 42 mesh residue, which are specified in JIS P 8207, is preferably 30-70 percent. Incidentally, weight percent of 4 mesh residue is preferably 20 weight percent or less.

The basic weight of base paper is preferably 30-250 g, but is most preferably 50-200 g, while the thickness of the base paper is preferably 40-250 μm.

Base paper may be given high smoothness employing calender finishing during or after paper making. The density of base paper is customarily 0.7-1.2 g/$cm^3$ (JIS P 8118). Further, the stiffness is preferably 20-200 g under conditions specified in JIS P 8143.

Surface sizing agents may be applied onto the surface of the base paper. Employed as surface sizing agents may be the same ones as those which can be incorporated in base paper.

The pH of base paper, when determined by the hot water extraction method specified in JIS P 8113, is preferably 5-9.

Polyethylene which is employed to cover the front and reverse surface of base paper is composed mainly of low density polyethylene (LDPE) and/or high density polyethylene (HDPE). However, it is possible to combine LLDPE and polypropylene.

It is preferable that opacity and whiteness of the polyethylene layer on the ink absorptive layer side are enhanced by incorporation of anatase type titanium dioxide into polyethylene, as is widely employed in photographic paper. The content of titanium oxide is customarily 3-20 percent by weight with respect to polyethylene, but is preferably 4-13 percent by weight.

Polyethylene coated paper is employed as a glossy paper. Further, it is possible to use polyethylene coated matte or silk surfaced paper, which is prepared as follows. When polyethylene is coated onto the surface of base paper employing melt extrusion, a matte or silk surface is formed on common photographic paper by employing so-called embossing treatments.

In the above polyethylene coated paper, it is particularly preferable to maintain the water content in the paper at 3-10 percent by weight.

It is possible to incorporate various types of additives into the porous ink absorptive layer according to the present invention. It is possible to incorporate various prior art additives such as polystyrene, polyacrylic acid esters, polymethacrylic acid esters, polyacrylamides, polyethylene, polypropylene, polyvinyl chloride, and polyvinylidene chloride, or copolymers thereof; minute organic latex particles of melamine resins, various types of cationic or nonionic surface active agents; UV absorbers described in JP-A Nos. 57-74193, 57-87988, and 62-261476; anti-discoloring agents described in JP-A Nos. 57-74192, 57-87989, 60-72785, 61-146591, 1-95091, and 3-13376; optical brightening agents described in JP-A Nos. 59-42993, 59-52689, 62-280069, 61-242871, and 4-219266; pH controlling agents such as sulfuric acid, phosphoric acid, citric acid, sodium hydroxide, potassium hydroxide, and potassium carbonate; antifoaming agents; antiseptics, thickeners; antistatic agents; and matting agents.

During application of the above porous ink absorptive layer onto a non-absorptive support, temperature is commonly maintained between 30-50° C. The cooling temperature after coating is acceptable when the temperature of the resulting coating is at most about 20° C., but it is preferable to control the above temperature at 15° C. or lower.

After coating, a cooling process is performed in such a manner that the resulting coating passes through a zone cooled, for example, to 15° C. or less for a definite duration (preferably at least 5 seconds). During this cooling, it is preferable not to blow an excessively strong air flow so that a uniform coating is obtained without forming uneven thickness of the coating.

Once the coating is cooled, even though a strong air flow is blown onto the coating, uniform thickness of the coating tends to result due to an increase in the viscosity of the liquid coating composition. Further, it is possible to blow a strong air flow at 20° C. or higher. However, it is preferable to gradually increase the temperature of the air flow.

After applying a porous ink absorptive layer liquid coating composition onto a support, a drying process is performed by blown air, allowing the coating to pass through a high temperature zone, or employing both.

In cases in which the coating is dried upon passing through a high temperature zone, it passes through a drying zone of 50-150° C. During this, it is preferable to choose an appropriate drying temperature, considering heat resistance of the support and adverse effects to the coating. Drying is commonly performed employing an air flow at a relative humidity of 10-50 percent but preferably at 15-40 percent. Drying time, obviously depending on wet layer thickness, is preferably within about 10 minutes, but is most preferably within 5 minutes.

The coating rate, though depending on wet thickness and the drying capacity of facilities, is commonly 10-1,000 m per minute, but is preferably 20-500 m.

The above liquid coating composition for the porous ink absorptive layer may be applied onto a support employing a method selected from prior art methods. For example, preferably employed are a gravure coating method, a roller coating method, a rod bar coating method, an air knife coating method, an extrusion coating method, a curtain coating method, or an extrusion coating method using a hopper, as described in U.S. Pat. No. 2,681,294.

A slot nozzle spray device, which is employed to coat water-based coating composition B in the production method of the ink-jet recording sheet of the present invention, will now be detailed with reference to drawings. However, the slot nozzle spray device (hereinafter sometimes referred to as the coating apparatus) is not limited to the embodiments illustrated in the exemplified drawings.

The production method of the present invention follows. Water-based coating composition A incorporating inorganic microparticle of an average primary particle diameter of at most 30 nm and hydrophilic binders are applied onto a non-absorptive support and the coating formed by the above water-based coating composition A is dried to form a porous ink absorptive layer. Thereafter, water-based coating composition B is applied onto the above porous ink absorptive layer, employing a slot nozzle spray device which incorporates a liquid coating composition nozzle which supplies the liquid coating composition across the coating width in the direction crossing with the conveying direction of the medium to be coated, as well as a gas nozzle which is adjacent to the aperture end of the above liquid coating composition nozzle and ejects gases.

The medium to be coated, as described in the present invention, refers to a subject to be coated in such a manner that by employing the production method of the present invention, water-based coating composition B is sprayed as droplets to be coated. Even though any structure is acceptable, the above body refers to a long belt-shaped support or an ink-jet recording medium composed of the above belt-shaped support having thereon an ink absorptive layer.

Further, in the present invention, continuous production is performed by relatively moving (conveying) a medium to be coated with respect to the liquid coating composition nozzle of a coating apparatus. The liquid coating composition nozzle of the coating apparatus has at least a length corresponding to the coating width (referring to the length of a portion to be coated of the above medium to be coated in the direction crossing with the conveying direction of the medium to be coated). Only by conveying the medium to be coated with respect to the coating apparatus, a liquid coating composition is applied onto the medium to be coated. In cases in which the medium to be coated is a long belt-shaped support, it is preferable that the belt-shaped support itself is conveyed in the longitudinal direction of the belt-shaped support, and the liquid coating composition nozzle of the coating apparatus is positioned across the width (in the direction at right angles against the longitudinal direction). By conveying the medium to be coated in the one-way direction with respect to the coating apparatus and by spraying a liquid coating composition across the coating width in the form of droplets, it is possible to coat a very thin layer of a highly uniform thickness, which minimizes the drying load.

Further, droplets sprayed from the liquid coating composition nozzle of a coating apparatus are required to be as follows; across the width of the medium to be coated, 1: the diameter distribution of droplets is uniform,
2: in the area range of a medium to be coated, onto which droplets fall, the falling length is uniform with respect to the conveying direction,
3: the falling angle is uniform with respect to the medium to be coated, and
4: the colliding rate of droplets falling onto the medium to be coated is uniform, whereby it is possible to secure high uniformity of coating thickness.

The expression that the "diameter distribution of droplets is uniform across the coating width" practically means that across the coating width, the variation of the diameter average of droplets is preferably ±20 percent but is more preferably ±10 percent.

It is possible to determine the variation of the diameter average of droplets by employing a laser diffraction type size distribution measurement instrument, and calculate the average. Specifically the measurement is performed employing the following measurement method.

Initially, a liquid coating composition is sprayed from a spraying device such as a slot nozzle spray device which sprays the liquid coating composition in the form of droplets and the resulting spraying state is stabilized. Immediately after the initiation of spraying, the ejected amount of the liquid coating composition as well as the gas pressure is not constant, resulting in an unstable spraying state. Therefore, it is possible to stabilize the spraying state by continuing the spraying over a specified time.

Subsequently, by employing SPRAYTECH RTS5123 (produced by Malvern Co.) as a laser diffraction type size distribution measurement instrument, the average diameter of droplets is determined at five locations at equidistant intervals across the coating width. Commonly since spraying density becomes excessively low at both edges (being the coating edges) across the coating width of the group of droplets falling onto the medium to be coated, they are not included in the effective coating width. Accordingly, both edges of the effective coating width are employed as the two points at both ends. Specifically, two positions at 1 cm from the coating edge are used as the two measuring locations of both edges. Then, three additional locations at equidistant intervals between the above two locations are determined to result in 5 total locations, which are the measuring locations. The variation ratio is then calculated based on the average diameter of droplets determined at the above 5 locations.

Incidentally, by employing SPRAYTECH RTS512, it is possible to readily determine an average diameter of droplets. Diameter of droplets at each of the above measurement locations is determined. Subsequently, integration plotting is performed, while the diameter of droplets is plotted on the abscissa, whereby the above average diameter of droplets refers to the diameter of droplets which locations at 50 percent in term of volume percent.

Further, as used herein, the expression "the length in the conveying direction in the area range while droplets fall on a medium to be coated is uniform" means that the aforesaid length variation is preferably ±10 percent across the coating width, but is more preferably ±5 percent.

Further, as used herein, "the spreading angle of droplets falling onto a medium to be coated" means that in the coating width direction, employing the liquid coating composition nozzle of a coating apparatus as a reference position, variation of the falling angle of droplets falling onto the medium to be coated is preferably ±10 percent but is more preferably ±5 percent.

Still further, as used herein, "the spatial density of the group of droplets falling onto the medium to be coated is uniform" means that the variation of the spatial density of the group of droplets falling onto the medium to be coated is ±10 percent, but is more preferably ±5 percent.

In order to achieve the above uniform spray, the present invention is characterized in that a slot nozzle spray device is employed. The slot nozzle spray device, as described herein, carries a plurality of nozzle slits ejecting a liquid coating solution across the coating width. Nozzle slits of each of the liquid coating compositions may be aligned or staggered. Further, it has the following mechanism. It carries a gas nozzles ejecting gases adjacent to each of the above nozzle slit of the liquid coating composition, and the gas ejected from the gas nozzles is allowed to collide with the liquid coating composition ejected from the above nozzle slits of the liquid coating composition to form droplets.

Employed as a preferable slot nozzle spray device in the present invention may, for example, be the one described in JP-A No. 6-170308. In JP-A No. 6-170308, an example is disclosed in which adhesives for disposable diapers are applied onto fiber employing the above slot nozzle spray device. In the above example, a liquid coating composition (being basically an adhesive) exhibiting an extremely high viscosity is allowed to fall from a liquid coating composition nozzle (being a liquid coating composition ejecting section) in the form of fiber, whereby the coating apparatus and the medium to be coated (being fiber) are connected via the above liquid coating composition in the form of fiber. Therefore, the liquid coating composition is not provided onto the medium to be coated in the form of discontinuous droplets, which are employed in the production method of the present invention. A fiber-shaped liquid coating composition, which fall in parallel from each of a plurality of liquid coating composition nozzles provided across the coating width, is disturbed by gas ejected from gas nozzles provided near the above liquid coating composition nozzles, whereby the vertical falling is disturbed, resulting in random deposition within a certain area range on the medium to be coated. When the gas nozzles are not employed, the fiber-shaped liquid coating composition falls vertically. By ejecting gas from the gas nozzles, it enables dispersion and deposition of the liquid coating composition over a wider region. However, the coating layer is shaped as if noodles are just spread and placed. The resulting coating is not one which is required for uniform and precise coating thickness on the entire area of the medium to be coated as described in the example of ink-jet recording sheet. Further, since the adhesives are coated, the resulting coating results in excessive thickness.

Further, in the present invention, it is possible to preferably use the slot nozzle spray coating apparatus disclosed in JP-A No. 5-309310. The example disclosed in JP-A No. 5-309310 shows coating of hot-melt type adhesives onto a medium to be coated in the same manner as in above JP-A No 6-170308. In the above example, since the liquid coating composition (adhesives) is highly viscous, a method is employed in which the liquid coating composition is continually ejected onto the surface of the medium to be coated in the form of fiber, whereby the uniformity of the resulting coating thickness is sufficiently secured and the resulting coating thickness is excessive.

In the present invention, particularly, in view of uniformity of coating and ease of coating, it is possible to preferably use the slot nozzle spray coating apparatus described in JP-A No. 2004-906.

It is possible to enhance the uniformity of spraying across the coating width, as described above, employing such a slot nozzle spray device, by employing the methods in which the viscosity of the liquid coating composition is decreased to a relatively lower level and the pressure of gas ejected from the gas nozzles is increased. Further, it is also possible to enhance uniformity of spray by decreasing the area of the aperture end of the liquid coating composition of the slot nozzle spray device and to decrease the pitch of the above aperture end.

The viscosity of liquid coating composition B is preferably 1-250 Pa·s, is more preferably 0.1-50 Pa·s, but is still more preferably 0.1-20 mPa·s. By applying such a low viscosity liquid coating composition to the slot nozzle spray device, it is possible to achieve a uniform liquid droplet spray across the coating width.

Still further, when droplets are formed by allowing pressurized gas to collide with a liquid coating composition employing a slot nozzle spray device, uniform spraying is readily realized under an internal gas pressure of at least 10 kPa, preferably at least 20 kPa, but more preferably at least 50 kPa. The flow rate of gas is commonly at least 3.5 CMM/m, is preferably at least 7 CMM/m, but is more preferably at least 10 CMM/m.

By scattering a liquid coating composition in the form of discontinuous droplets instead of a continuous fiber shape across the medium to be coated employing the above method, it is possible to apply a liquid coating composition onto the medium to be coated, even though the total amount of the liquid coating composition is small, whereby it is possible to realize a more uniform coating thickness. Further, since individual droplets are applied onto a medium to be coated, the amount of the liquid coating composition decreases, whereby the drying load is minimized.

The practical structure of the slot nozzle spray coating device employed as the coating apparatus according to the present invention will now be described.

FIG. 1 is a schematic view to describe the production method of the present invention. In FIG. 1, reference numeral 1 is the slot nozzle spray section of a slot nozzle spray device (the whole apparatus is not shown), while 9 is a medium to be coated in the form of a long belt-shaped support.

Medium 9 to be coated is conveyed at a definite rate in the conveying direction, shown by the single arrow in FIG. 1, which is in the longitudinal direction of medium to be coated 9, employing a conveying device (not shown). Liquid coating composition nozzle C of slot nozzle spray section 1 has a length across the width of medium 9 to be coated which is at right angles to the conveying direction and is arranged to face the coating surface of medium 9 to be coated. The liquid coating composition is sprayed in the form of droplets from liquid coating composition nozzle C, and the resulting droplets are deposited onto medium 9 to be coated, whereby coating is achieved. During this coating operation, the liquid coating composition adhered length across the width of medium 9 to be coated corresponds to the coating width shown by the arrow in FIG. 1. In FIG. 1, even though the coating width is less than the width of medium 9 to be coated, both lengths may be the same.

Figure 2:
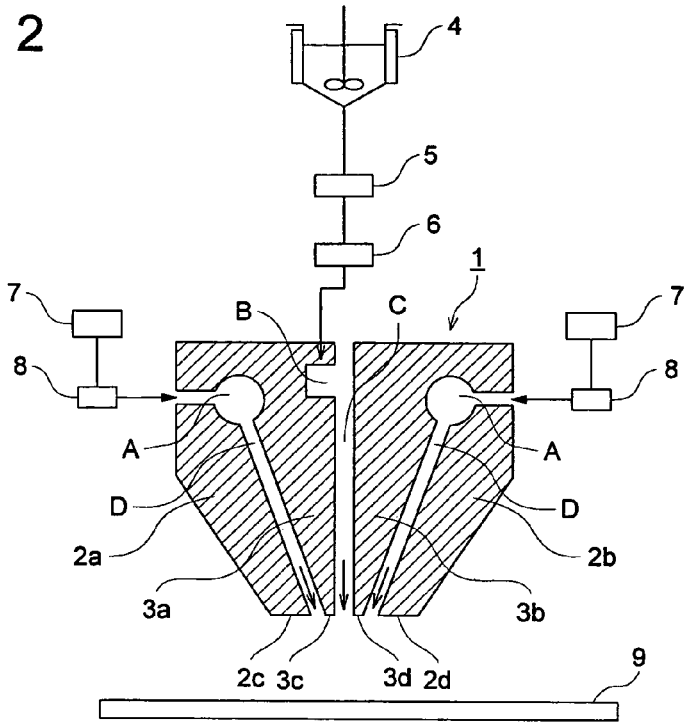
FIG. 2 is a schematic sectional view showing an example of the slot nozzle spray device including a slot nozzle spray section which contains a coating nozzle C and a gas nozzle D.

FIG. 2 is a schematic sectional view of one example of a slot nozzle spray device, including the slot nozzle spray section, described in FIG. 1.

Slot nozzle spray section 1 incorporates a pair of interior die blocks 3*a* and 3*b* as well as a pair of external die blocks 2*a* and 2*b* on the exterior of each of the paired above interior die blocks 3*a* and 3*b*, so that liquid coating composition nozzle C is formed between paired interior die blocks 3*a* and 3*b*, while gas nozzle D is respectively formed between interior die block 3*a* and exterior die block 2*a*, as well as between interior die block 3*b* and exterior die block 2*b*.

In FIG. 2, slot nozzle spray section 1 incorporates paired gas nozzles D having reservoirs A as well as liquid coating nozzle C having liquid coating composition reservoir B. The liquid coating composition exhibits a viscosity (preferably 0.1-250 mPa·s) which makes it possible to form droplets without forming fiber shape. For example, a liquid coating composition of such as a function-providing compound containing solution is placed in preparation vessel 4, fed to liquid coating composition reservoir B via pump 5 and flow meter 6, and then fed to liquid coating composition nozzle 3. Further, compressed air is fed to gas nozzles 2 from compressed air source 7 via valve 8 and gas reservoir A. During coating, a liquid coating composition is fed from preparation vessel 4 to reach a specified coating amount, and simultaneously, pressurized air is blown from paired gas nozzles D so that the continuous liquid coating composition is transformed into droplets, sprayed and deposited onto medium 9 to be coated. A major feature of the production method of the present invention is that it is possible to spray a liquid coating composition in the form of minute droplets instead of fiber shape. By supplying the liquid coating composition onto the surface of medium 9 to be coated in the form of minute droplets, it is possible to form a thin layer of extremely high uniformity at a high rate under minimal drying load.

Figure 3:
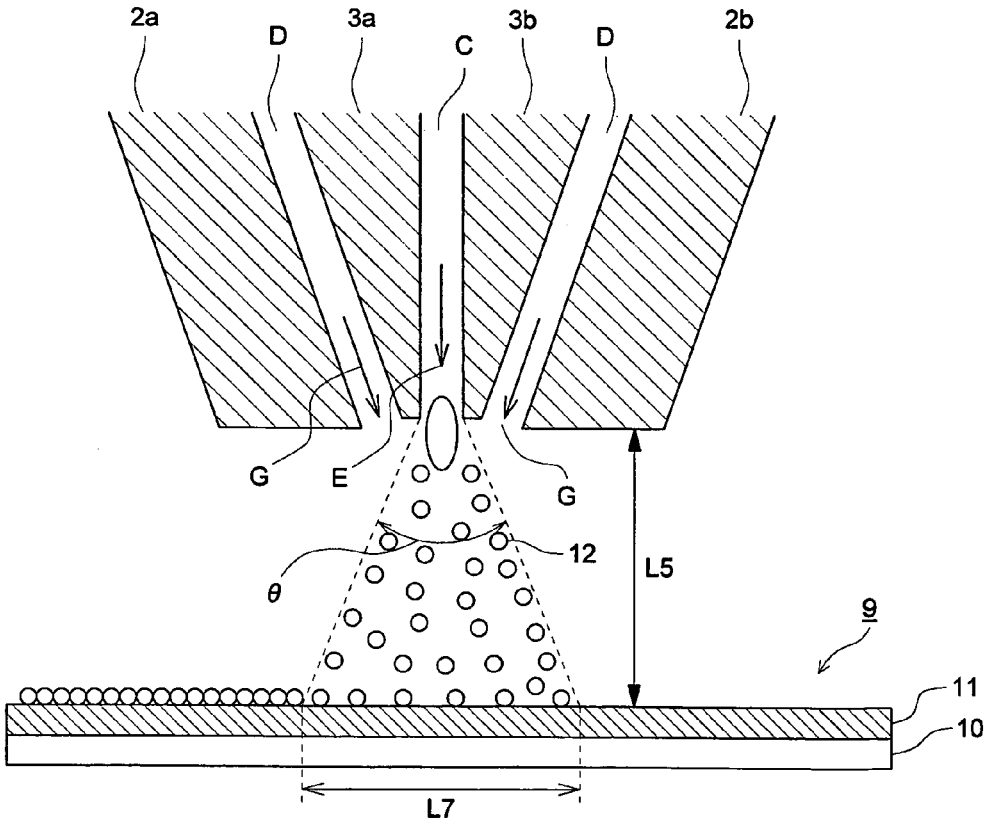
FIG. 3 is a schematic view to describe a slot nozzle spray section, the formation of droplets formed therein, and the ejected state.

With reference to FIG. 3, described will be a slot nozzle spray section, the formation of droplets formed therein, and the ejection state.

In FIG. 3, liquid coating composition E ejected from liquid coating composition nozzle C is subjected to subdivision and conversion to droplets by compressed air G fed from gas nozzles D which are arranged near both sides of liquid coating composition nozzles C, resulting in the formation of droplets 12 exhibiting a nearly spherical shape, which are ejected and uniformly deposited onto the surface of medium 9 to be coated at a gap of L5. In FIG. 3, medium 9 to be coated is shown as a model in which ink absorptive layer 11 is applied onto support 10 as a constituting layer. It is preferable that the area range of droplets 12 of the liquid coating composition deposited on medium 9 to be coated is always uniform. Specifically, it is preferable that the distance in the conveying direction in FIG. 3, (described as L7) is uniform across the coating width. Further, it is also preferable that spread angle θ of the group of sprayed droplets with respect to the medium to be coated, while employing the aperture end of liquid coating composition nozzle C as a standard position, is uniform across the coating width.

Figure 4:
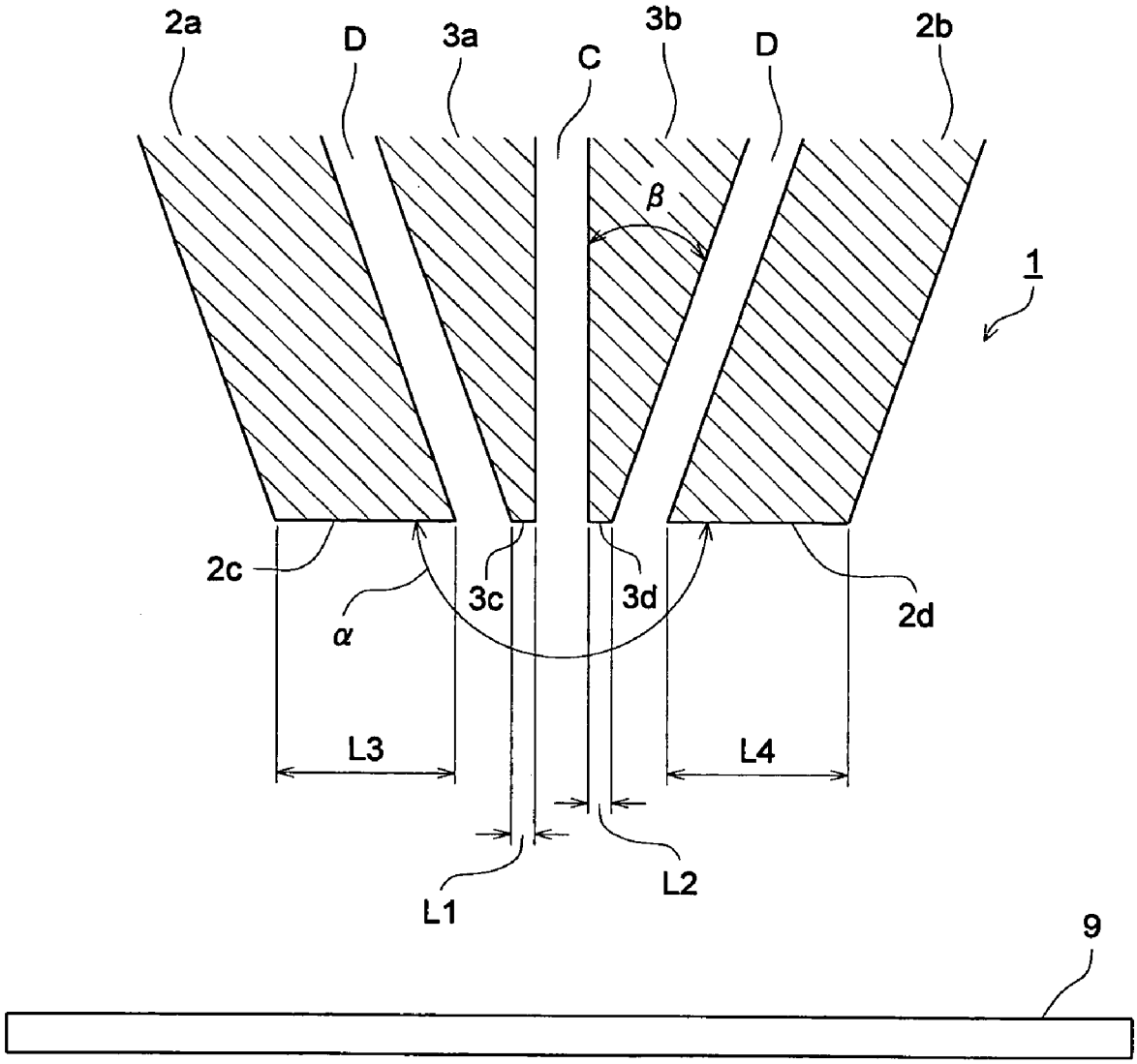
FIG. 4 is a schematic sectional view showing an example of the feature of the constitution of the slot nozzle spray section employed in the present invention.

FIG. 4 is a schematic sectional view showing features of the constitution of the slot nozzle spray section employed in the present invention.

In FIG. 4, angle β of liquid coating composition nozzle C formed between internal die blocks 3*a* and 3*b*, with respect to gas nozzles D formed between internal die block 3*a* and external die block 2*a*, and also between internal die block 3*b* and external die block 2*b* is preferably 15-60 degrees. Specifically, in many cases, liquid coating composition nozzle C is arranged to be perpendicular with respect to the surface of the medium to be coated. In that case, gas nozzles are arranged at angle β of inclination of 15-60 degrees with respect to the vertical direction. As noted above, by arranging liquid coating composition C and gas nozzles D to result in the specified angle, it is possible to achieve stable formation of droplets of the liquid coating composition, whereby it is possible to realize coating exhibiting high uniformity by a decrease in non-uniformity due to streaking as well as other coating problems.

Further, in the coating apparatus according to the present invention, angle β of the medium to be coated with respect to the basal plane of a pair of external die blocks which are positioned to face the medium to be coated is preferably from 170 to 240 degrees.

In above FIG. 4, when the basal planes of external blocks 2*a* and 2*b* which face medium 9 to be coated are designated as 2*c* and 2*d*, respectively, angle α formed by basal planes 2*c* and 2*d* is preferably 170-240 degrees. In FIG. 4, a state is exemplified in which each of basal planes 2*c* and 2*d* are horizontal with respect to medium 9 to be coated and angle α is 180 degrees, while each of basal planes 2*c* and 2*d* may be formed in such a state that they are declined against medium 9 to be coated.

Further, in the coating apparatus according to the present invention, it is preferable that each of width L1 and L2 of the basal plane of a pair of internal die blocks which faces the medium to be coated is at most 1 mm, and each of width L3 and L4 of the basal plane of the paired external die blocks which face the medium to be coated is 1-50 mm. Namely, in FIG. 4, when basal planes of internal die blocks 3*a* and 3*b* which face medium 9 to be coated are designated as 3*c* and 3*d*, respectively, each of the width of basal planes 3*c* and 3*d* is preferably at most 1 mm, but is more preferably 0.2-1.0 mm.

Further, when basal planes of internal die blocks 2*a* and 2*b* which face medium 9 to be coated are designated as 2*c* and 2*d*, respectively, each of width L3 and L4 of basal planes 2*c* and 2*d* is preferably 0.1-50 mm, but is more preferably 0.1-30 mm.

Figure 5:
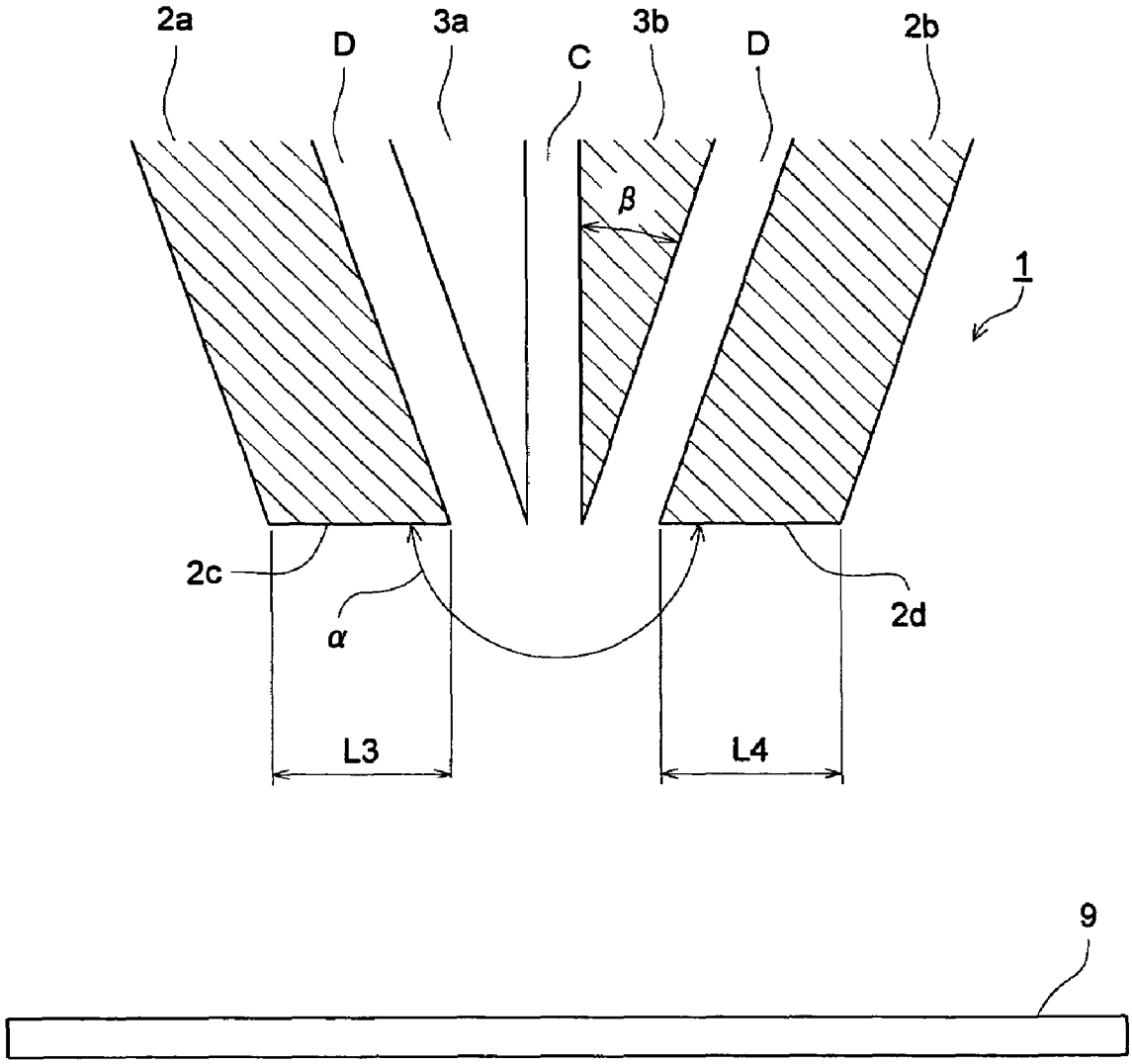
FIG. 5 is a schematic sectional view showing an example of features of another constitution of the slot nozzle spray section employed in the present invention.

Still further, FIG. 5 is a schematic sectional view showing the features of the structure other than the slot nozzle spray section employed in the present invention. The slot nozzle spray section shown in FIG. 5 differs from above FIG. 4, such that bottom planes 3*c* and 3*d* are not provided with a pair of internal die blocks but the tip is formed to result in an acute angle.

In the coating apparatus composed of the slot nozzle spray device of the present invention, as constituted above, in view of minimizing adhesion of sprayed droplets, it is preferable that at least one selected from the aperture surface of the slot nozzle spray device, the gas flow channel wall of the aforesaid gas nozzle, and the flow channel wall of the aforesaid liquid coating composition nozzle is subjected to water-repellent surface finishing.

The aperture surface of the slot nozzle spray device, as described herein, refers to each of basal planes 2*c*, 2*d*, 3*c*, and 3*d* of slot nozzle spray section 1 which faces medium 9 to be coated. In the following, the surface adjacent to the ejection outlet of the liquid coating composition nozzle or the gas nozzles according to the present invention is designated as a basal plane or a basal plane section.

Further, in the coating apparatus according to the present invention, in view of exhibiting more targeted effects of the present invention, it is preferable that the gas flow channel walls of the gas nozzle, or the liquid flow channel wall of the liquid coating composition, are subjected to surface water-repellent finishing.

The gas flow channel wall, as described in the present invention, refers to the wall surfaces which form a flow channel from gas reservoir A to which pressurized air is fed from pressurized air source 7 via valve 8 to gas nozzles D. Further, the liquid flow channel wall of the liquid coating composition nozzle refers to the walls which form the flow channel from liquid coating composition reservoir B which feeds the liquid coating composition via pump 5 and flow meter 6 to liquid coating composition nozzle C.

In the coating apparatus according to the present invention, when the surface of the above-mentioned specific portion of the slot nozzle spray device according to the present invention is subjected to water-repellent finishing, it is possible to achieve the targeted desirable effects of the present invention. Further, it is also possible to provide the desired surface water-repellent capability by performing a surface finishing employing methods in which the above specified sections are constituted employing water-repellent components, covering is performed employing a water-repellent film, or surface finishing is performed employing coating or evaporation of water-repellent agents.

The surface water-repellent finishing, as described in the present invention, refers to finishing in which the contact angle of the specific surface to pure water reaches at least 90 degrees. The resulting contact angle against pure water is preferably at least 100 degrees, but is more preferably at least 105 degrees. In the present invention, in view of machining accuracy and durability, markedly preferred as materials, which are employed in the main body of the slot nozzle spray section, are metals, especially stainless steel. Accordingly, as to surface water-repellent finishing, it is preferable to perform surface water-repellent finishing, employing fluorine-containing silane coupling agents, amorphous silicon-containing polymers, fluororesins, or water-repellent plating.

Fluorine-containing silane coupling agents are readily commercially available from, for example, Toray-Dow Corning Silicone Co., Ltd., Shin-Etsu Chemical Co., Ltd., Daikin Industries, Ltd. (for example, OPTOOL DSX), Gelest Inc., and Solvay Solecsis Co., Ltd. In addition, it is possible to synthesize them employing synthesis methods described, for example, in J. Fluorine Chem., 79(1), 87 (1996), Zairyo Gijutsu (Material Technology) 16(5), 209 (1998), Collect. Czech. Chem. Commun., Volume 44, pages 750-755, J. Amer. Chem. Soc., 1990, Volume 112, pages 2341-2348, Inorg. Chem., Volume 10, pages 889-892, 1971, U.S. Pat. No. 3,668,233, and JP-A Nos. 58-122979, 7-242675, 9-61605, 11-29585, 2000-64348, 2000-144097, or synthesis methods based on the above methods.

Further, preferably employed as amorphous fluorine-containing polymers are fluorine based polymers such as SAITOP (produced by Asahi Glass Co., Ltd.), as well as polydiperfluoroalkyl fumarate, TEFLON (registered trade name), and AF (all products of Du Pont Co.), or alternative polymers of fluorine-containing ethylene with hydrocarbon based ethylene such as alternate polymers of diperfluoroalkyl fumarate with styrene, alternative polymers of tetrafluoroethylene chloride with vinyl esters, or alternative polymers of tetrafluoroethylene chloride with vinyl esters, as well as analogs and derivatives thereof, and FUMARITE (produced by NOF Corp.).

These fluorine-containing polymers are soluble in selective fluorine based organic solvents. Accordingly, they are dissolved in solvents at an optional concentration and then coated. Compared to polytetrafluoroethylene and polychlorotrifluoroethylene which are coated only in the form of powder or dispersion media, the resulting coating layer exhibits high adhesion to each of the members of the main body of the slot nozzle spray section, and further it is possible to form the desired uniform coating layer. The concentration of fluorine-containing polymers in a liquid coating composition is in the range of 0.01-7 percent by weight.

Preferably employed as fluorine based organic solvents which are used as the above fluorine-containing silane coupling agents may be NOVEK HFE. Preferably employed as fluorine based organic solvents used for amorphous fluorine-containing resins are silane florinate, and NOVEK HFE (all produced by 3M Co.), GARUDEN (produced by Montefluos Co.), trifluoromethylbenzene, and hydrofluorocarbon.

Prior art coating methods may be employed as a method for applying fluorine-containing polymers onto the main body of the slot nozzle spray section. For example, any of the methods such as a dipping method, a spray coating method, a spin coating method, or a transfer method may appropriately be selected and then employed.

The amount of the fluorine-containing polymers applied onto the main body of the slot nozzle spray section is not particularly limited as long as the amount is in the range which makes it possible to realize the desired contact angle for water. However, in the case of using fluorine-containing silane coupling agents, the amount is commonly 0.001-0.1 $g/m^2$, but is preferably 0.001-0.01 $g/m^2$. Further, in the case of using amorphous silicon-containing resins, the amount is commonly 0.01-10.0 $g/m^2$, but is preferably 0.01-1.0 $g/m^2$.

Further, when fluorine-containing polymers are employed for coating, their adhesion to a support is markedly enhanced utilizing a method in which fluororesins are applied onto the support and are subjected to thermally burning.

Widely employed as fluorine-containing resins employed for coating employing fluorine-containing resins according to the present invention may be those known in the art. Specific examples include PTFE (polytetrafluoroethylene), known as TEFLON (a registered trade name), (available from Du Pont Co.), FEP (perfluoroethylene-propane copolymers), PFA (perfluoroalkoxyalkane), ETPE (ethylene-tetrafluoroethylene copolymers), ECTFE (ethylene-chlorotrifluoroethylene copolymer), FVDF (polyvinylidne-fluoride), PCTFE (polychlorotrifluoroethyne), and TFE/PDD (tetrafluoroethylene-perfluorodioxazole copolymers).

Employed as coating methods of fluorine-containing resins may be a dipping method, a spray coating method, and a spin coating method. In addition, employed may be an electrodeposition coating method.

In order to enhance the adhesion of fluororesins onto supports, it is preferable to perform pre-treatments prior to coating. Pre-treatments, as described herein, refer to any treatments which are performed to enhance adhesion of fluororesins onto supports and include solvent cleaning of supports, degreasing such as burning, increase in surface roughness employing blasting, and flame spray coating of metals and ceramics. These pre-treatments may be performed individually or in combinations of a plurality of them. It is preferable that after degreasing, blasting is performed. The resulting coating may be composed of a single layer or a plurality of layers.

Fluororesins may be employed individually or in combinations of a plurality of them for coating. Further, resins other than fluororesins may be simultaneously employed. In such a case, employed as resins other than fluororesins may be epoxy resins, polyaminoimide resins, polyether sulfone resins, and polyether ether ketone resins.

Fluororesins, after coating, are subjected to burning as a heat treatment. The temperature of the heat treatment varies depending on the employed resins but is preferably 250-400° C. Further, during this treatment, in order to decrease distortion of the stainless steel body, it is preferable that prior to coating fluorine-containing resins, the stainless steel host material is subjected to the above heat treatment and then modified to the shape of the coating apparatus.

Further, after coating fluororesins, in order to assure smoothness and straightness, it is preferable to carry out grinding. The layer thickness after grinding is preferably 10-100 μm, but is more preferably 20-70 μm.

Further, employed as a surface water-repellent treatment usable in the present invention may be a plating method which results in a fluororesin eutectoid. In the above method, fluororesins are dispersed into a plating solution and the support is subjected to plating, whereby desired adhesion properties and high hardness are obtained.

Employed as a plating layer which is subjected to a fluororesin eutectoid are prior art plating layers. In view of hardness, corrosion resistance, and adhesion to host materials, it is preferable that plating layers are composed of nickel and chromium. Further, since uniformity, straightness, and smoothness of the plating layers are highly demanded, electroless nickel plating utilizing only chemical reactions is preferred.

Widely employed as fluororesins which are subjected to eutectoid may be those known in the art. Specific examples include PTYFE (polytetrafluoroethylene), known as TEFLON (a registered trade name) available from Du Pont Co.), FEP (perfluoroethylene-propane copolymers), PFA (perfluoroalkoxyalkane), ETFE (ethylene-tetrafluoroethylene copolymers), ECTFE (ethylene-chlorotrifluoroethylene copolymers), FVDF (polyvinylidene fluoride), PCTFE (polychlorotrifluoroethyne), and TFE/PDD (tetrafluoroethylene-perfluorodioxole copolymers). In view of water-repellence, it is preferable to use PTFE.

In view of water repellence and uniform coverage, the diameter of fluororesin particles which are subjected to eutectoid is preferably 0.1-1 μm, but is more preferably 0.3-0.6 μm.

Further, in view of water repellence and uniform coverage, the amount of fluororesins in a plating solution is preferably 5-35 percent, but is more preferably 20-30 percent.

Plating, as described herein, refers to electroless plating. Specifically, for example, dispersed minute TEFLON (a registered trade name) particles are subjected to eutectoid. Listed as electroless plating solutions are NIMUFRON FRS, NIMUFRON, and NIMUFRON-T, sold by Uyemura & Co., Ltd.; TOP NICOJIT-TF, TOP NIKOJIT FL, and TOP NICOJIT AL, sold by Okuno Chemical Industries Co., Ltd; and KANIFRON sold by Japan Kanigen Co., Ltd.

Prior to the formation of a plating layer, it is possible to perform a pre-treatment of supports. The pre-treatment, as described herein, includes degreasing employing heat, solvents, and electrolysis, cleaning employing acids, and formation of a plating layer on the support. Commonly, a combination of these treatments are performed. In order to enhance adhesion of the plating layer, it is preferable to perform Ni plating as a support after degreasing and acid cleaning.

In cases in which high hardness is required for the plating layer, it is possible to perform a heat treatment at 200-300° C. for about one hour after forming a plating layer in which fluororesins are subjected to a eutectoid. Further, in such a case, in order to minimize distortion of stainless steel apparatus parts due to the heat treatment, it is preferable that a stainless steel host material is subjected to heat treatment prior to plating and then modified to the required shape of the coating apparatus.

Further, in order to achieve desired smoothness and straightness, it is possible to perform grinding after forming the plated layer. In view of uniformity, thickness of plated layers is preferably 2-20 μm, but is more preferably 3-10 μm. When grinding is performed, the layer thickness of the plated coverage after grinding is preferably 2-20 μm, but is more preferably 3-10 μm.

Further, detailed below is the coating apparatus according to the present invention.

Figure 6:
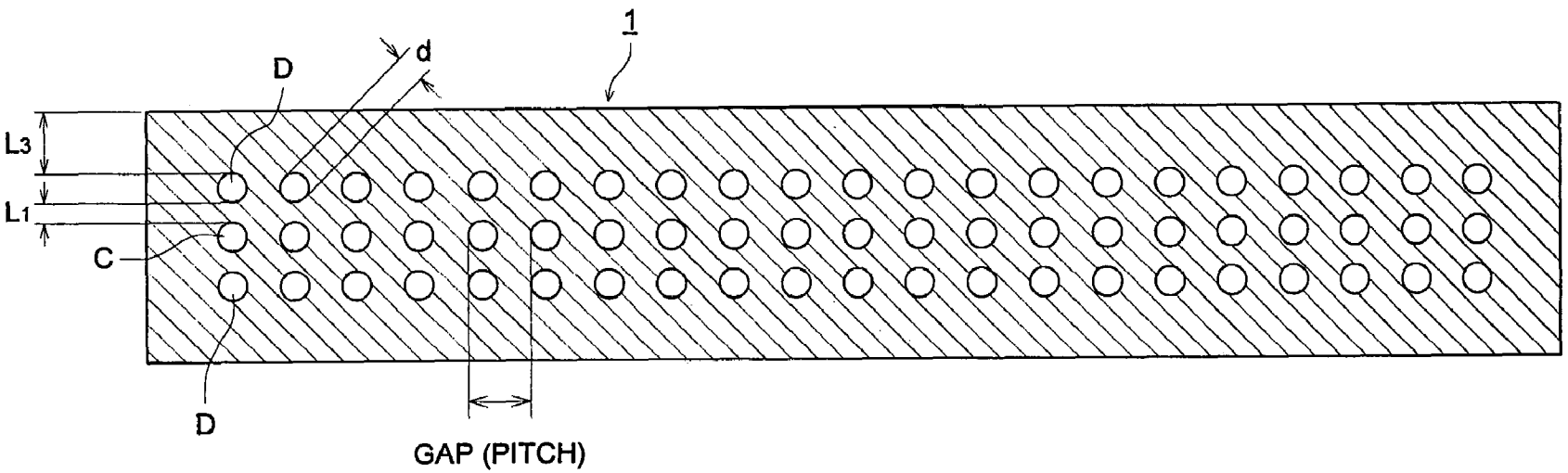
FIG. 6 is a schematic view showing an example of the slot nozzle spray section of FIG. 2, which is viewed from the side of liquid coating composition nozzle C (or it is also called simply as a coating nozzle C).
Figure 7:
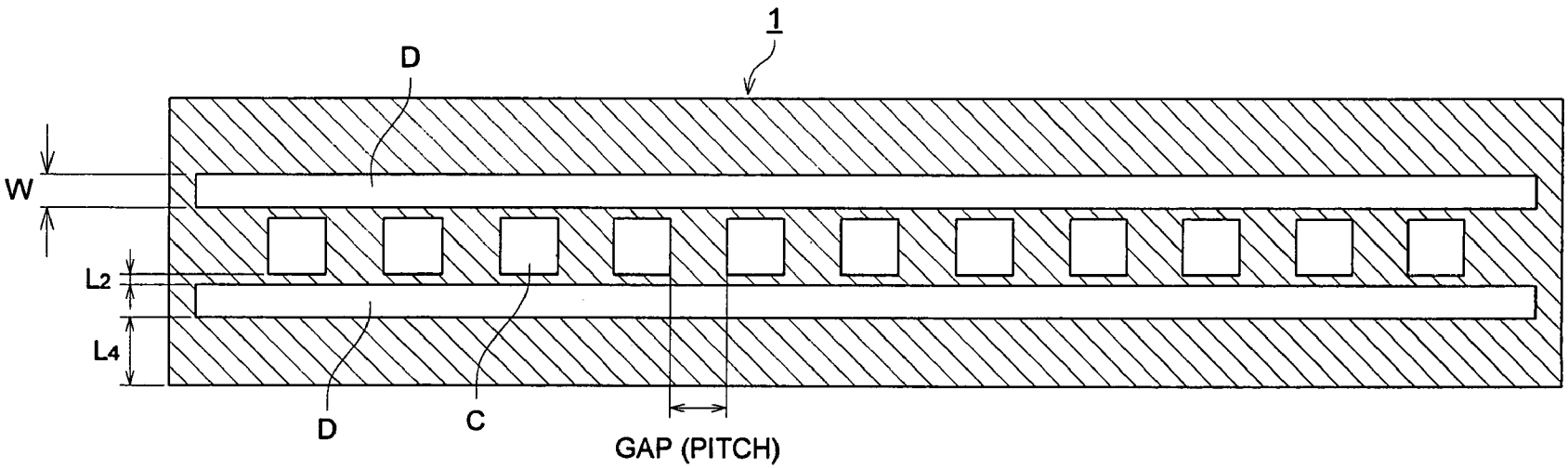
FIG. 7 is a schematic view showing another example of the slot nozzle spray section of FIG. 2 which is viewed from the side of liquid coating composition nozzle C.

Each of FIGS. 6 and 7 is a schematic view of the nozzle spray section of FIG. 2, which is viewed from the side of liquid coating composition nozzle C, and shows the aperture end of a plurality of liquid coating composition nozzles C arranged across the coating width, as well as the aperture end of gas nozzles D.

In the liquid coating composition nozzles shown in FIG. 6, 21 liquid coating composition nozzles C, having a circular aperture end, are aligned across the coating width. Further, this embodiment is such that gas nozzles D are arranged near both sides of the aperture end of each liquid coating composition nozzle C. Liquid coating composition nozzles C are arranged at equal intervals, while gas nozzles D is also arranged at equal intervals. Herein, one liquid coating composition nozzle C and two corresponding gas nozzles D are aligned in the direction at right angels across the coating width. Alternately, liquid coating composition nozzles C and gas nozzles D may be staggered. It is preferable that the distance (the pitch) of the aperture end of liquid coating composition nozzle C or the aperture end of gas nozzle D is a specific value.

The liquid coating composition nozzle shown in FIG. 7 is different from the embodiment described in FIG. 6. Eleven liquid coating composition nozzles C, of a rectangular aperture end, are aligned. Further, across the coating width, with respect to all liquid coating composition nozzles C, gas nozzles in the form of a slit are aligned as a pair on each side of the aperture end. In this embodiment, the each aperture end of a plurality of rectangular liquid coating composition nozzles is aligned at equal intervals.

Figure 8:
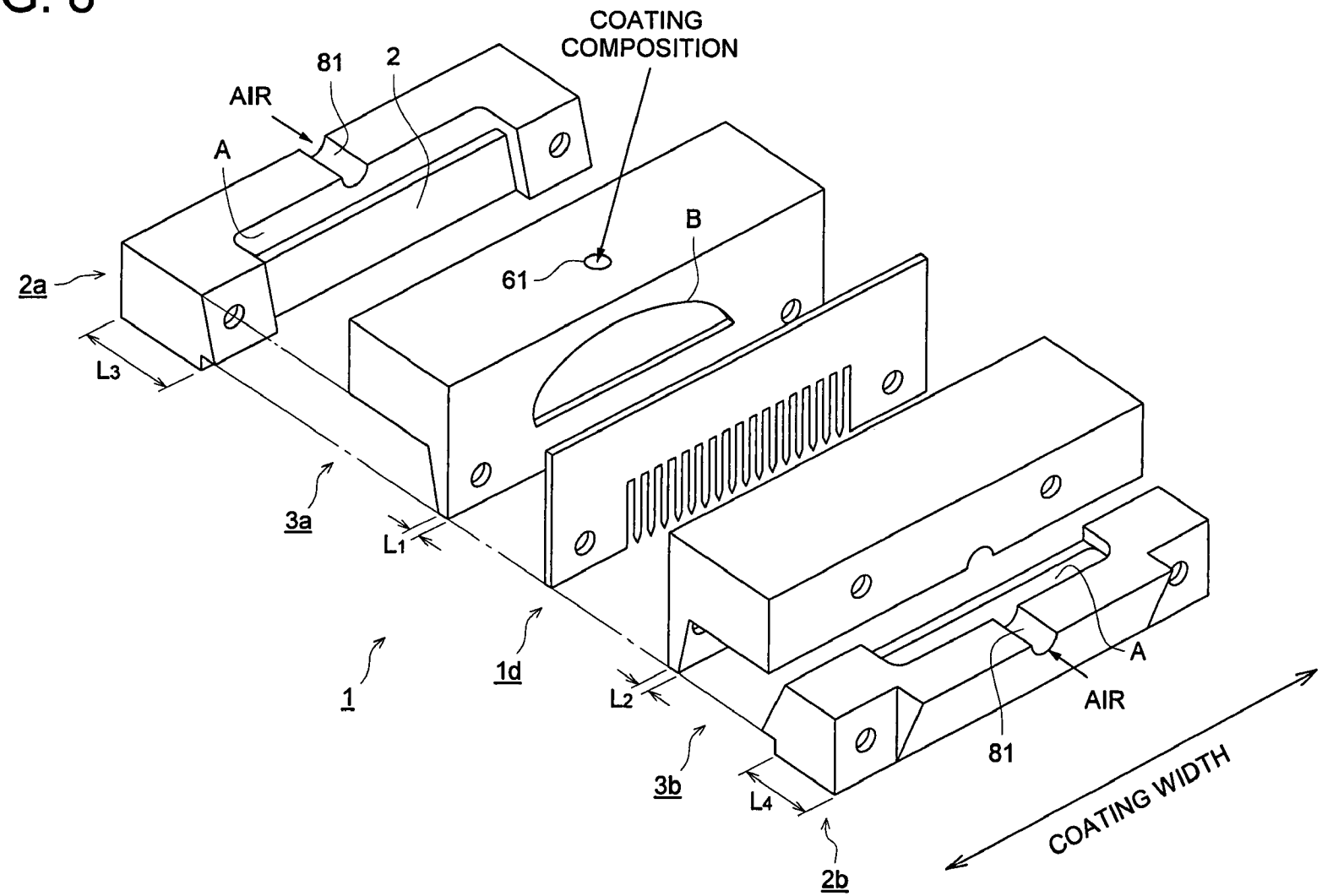
FIG. 8 is an exploded perspective view showing an example of the slot nozzle spray section of a liquid coating composition nozzle of a slot nozzle spray device.

FIG. 8 is an exploded perspective view of a slot nozzle spray section having a liquid coating composition nozzle of such a type as in FIG. 6. In FIG. 8, reference symbols 3*a* and 3*b* are internal die blocks which form a liquid coating composition slit of the specified distance and allow the liquid coating composition to flow down to the above slit. Die block 3*a* on one side receives the liquid coating composition supplied from a liquid coating composition supplying source (not shown) and is provided with liquid coating composition feeding pipe 61 connected to liquid coating composition reservoir B. The liquid coating composition which is pooled in liquid coating composition reservoir B is allowed to flow down the liquid coating composition slit formed between internal die blocks 3*a* and 3*b*. Reference symbol 1*d* is a shim sandwiched between internal blocks 3*a* and 3*b*, and perpendicularly divides the liquid coating composition slit formed between internal blocks 3*a* and 3*b* to form a plurality of liquid coating composition nozzles across the coating.

Further, 2*a* and 2*b* are external die blocks for feeding gas, and form between them gas nozzle D (not shown) which passes compressed gas. In this case, gas nozzle D is a slit extending across the coating width. Compressed air from an air feeding source (not shown) is fed to air feeding pipe 81 of each of external die blocks 2*a* and 2*b*. After temporarily stored in gas reservoir A, pressurized air flows down through nozzle D (not shown) formed between the internal block and the external block.

The liquid coating composition which flows through the spaces above shim id collides with the compressed air flowing from two gas nozzles on both sides of the liquid coating composition nozzle at the bottom of slot nozzle spray section 1 to form droplets which are deposited onto the medium to be coated which is the support to be coated.

In the slot nozzle spray apparatus employed in the present invention, the shape of the aperture end of the liquid coating composition nozzle may be either circular or rectangular. The usable size is in the range of 50-300 μm, while it is preferable that the pitch (the distance) is controlled to be 100-3,000 μm. On the other hand, the shape of the aperture end of gas nozzles may be circular or in the form of a slit extending across the coating width. At the time, the usable diameter (d shown in FIG. 6) or slit width (w in FIG. 6) is commonly in the range of 50-500 μm. It is also a characteristic that the angle of the gas nozzle with respect to the liquid coating composition nozzle is in the range of 15-60 degrees. The above range is preferably 15-45 degrees. Further, the distance (L5 shown in FIG. 2) between the liquid coating composition nozzle of the slot nozzle spray section and the medium to be coated is preferably in the range of 0.2-10 cm, is more preferably 0.5-6.0 cm, but is still more preferably 1.0-3.5 cm.

The amount of the liquid coating composition fed from the liquid coating composition nozzle is not generally specified due to the dependence of the desired coating thickness, the concentration of liquid coating compositions, and the coating rate, but the coating amount on the medium to be coated is preferably 0.5-50 g/m$^2$. When the coating amount is less than 0.5 g/m$_2$, it is difficult to consistently form a uniform coating, while when it exceeds 50 g/m$^2$, it is difficult to effectively exhibit desired effects of the present invention, while in addition the drying load is adversely affected. The wet layer thickness of a liquid coating composition is preferably 1-50 μm, but is more preferably 5-30 μm.

On the other hand, any of the gases which are ejectable from gas nozzles may be employed as long as they are suitable for coating, but air is generally employed. The gas feeding rate is preferably in the range of about 1 to about 50 MM/m (a flow rate per coating width). In view of coating uniformity, the internal pressure within the gas nozzle is preferably at least 10 kPa.

In view of effectively achieving objects of the present invention, linear air flow rate v is preferably 100-400 m/s. Specifically, in view of drying properties, v is preferably at least 100 m/s, while in view of the drying yield, v is preferably at most 400 m/s.

The linear air flow rate, as described in the present invention, refers to the linear air flow rate immediately after exiting the gas nozzle. It is possible to determine the flow rate employing a laser Doppler anemometer such as 1D FLV system 8851, produced by KANOMAX Co. Further, the coating yield, as described herein, refers to the liquid coating composition amount applied onto the medium to be coated/total supplied liquid coating composition amount×100 (in percent) capable of being calculated based on a weighing method. Namely, the liquid coating composition amount applied onto the medium to be coated is calculated based on the weight variation prior to and after coating the medium to be coated. It is possible to determine the total supplied liquid coating composition amount based on the weight of the liquid composition and supplied weight, namely the feeding flow rate×coating time.

Further, in view of effectively achieving the objects of the present invention, the average diameter of droplets of the liquid coating composition is preferably 10-70 μm. The average diameter of droplets, as described in the present invention, refers to the average droplet diameter in the coating gap (distance L5 between the liquid coating composition nozzle and the medium to be coated), which can be determined employing a laser diffraction system particle diameter measuring instrument such as RST114, produced by MALVERN Co.

In the present invention, in view of minimizing coating problems due to formation of scattered materials and their adhesion, it is preferable that as a coating initiation method, after supplying gas via the gas nozzles which eject gas of the slot nozzle spray device, the liquid coating composition is supplied to water-based coating composition B from the liquid coating composition nozzle supplying liquid coating compositions.

Figure 9:
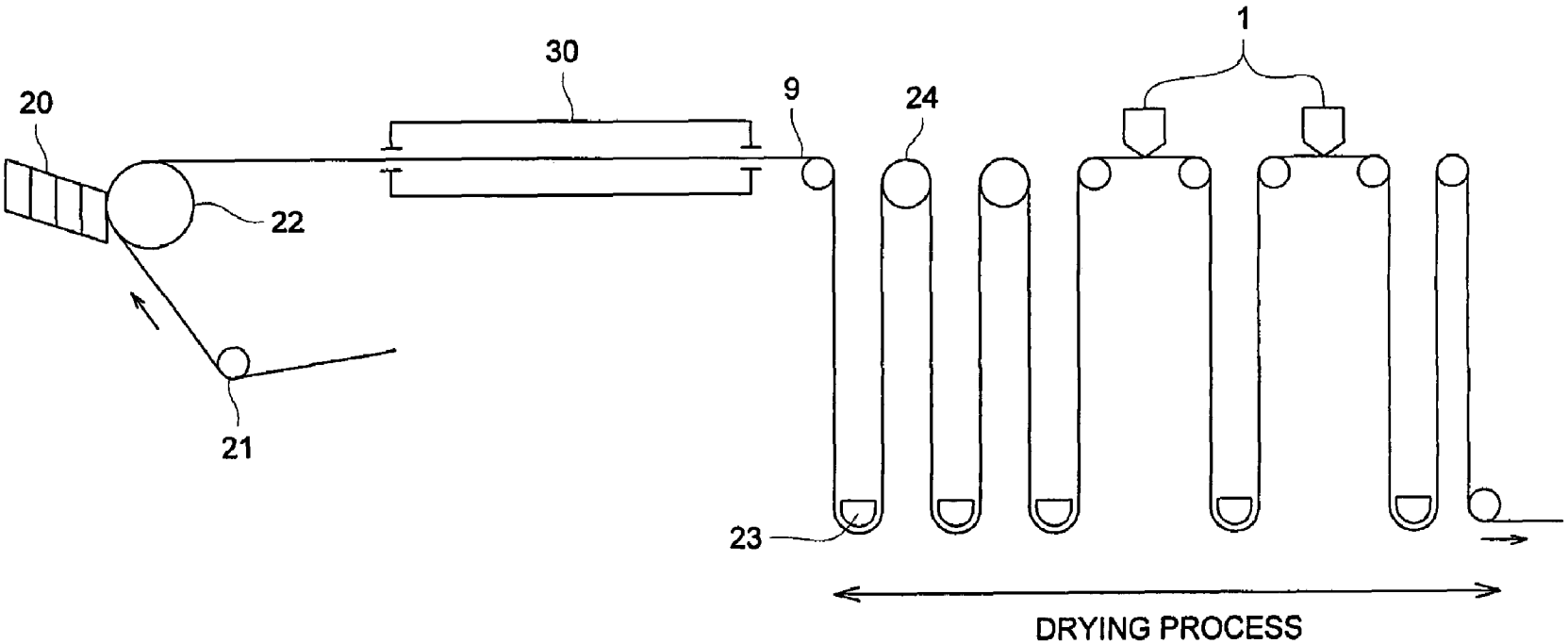
FIG. 9 is a schematic view showing an example of a coating production line in which a slot nozzle spray device is arrayed.

FIG. 9 shows one example of the coating production line in which the slot nozzle spray device described above is arranged. Herein, employed as a medium to be coated is one which incorporates a support having thereon a constituting layer. After coating the above constituting layer, in the drying process, a plurality of slot nozzle spray devices (in a multi-stage) are aligned. Coating, in which, as noted above, the formation of a constituting layer and coating of an overcoat layer (being the uppermost layer) is performed, is designated as on-line coating.

A support is fed from a support master roll, employing a conveying device (not shown), passes over conveying roller 21, and is reversed by back-up roller 22. During the above process, a porous ink absorptive layer (a constituting layer) liquid coating composition supplied from flow rate controlling type slide bead coating device 20 is applied onto the support. The above porous ink absorptive layer liquid coating composition incorporates hydrophilic binders, whereby the resulting coating is temporarily cooled in cooling zone 30 and thermally set. Medium 9 to be coated, which incorporates a support having thereon a constituting layer, is conveyed to a drying process. In the drying process, medium 9 to be coated is subjected to meandering conveyance in such a manner that reverser 23, which performs reversal conveyance with no contact of the coating surface employing blown air, and common conveying rollers 24 are alternately arranged. In the above drying process, drying is achieved by blowing heated air (the heated air blowing device is not shown). During the above drying process, preferably at the point after falling-rate drying, coating employing sprayed droplets of the present invention, as described above, is performed employing two slot nozzle spray devices 1. In view of drying properties, it is preferable that at least one of the two slot nozzle sprays is arranged at the point of completion of drying. Herein employed are two slot nozzle spray devices, but only one or three devices may also be used. By performing coating employing droplet spray under multi-stages, it was discovered that drying load was further decreased and the uniformity of the layer thickness was also enhanced.

The coating rate during formation of a thin layer on the medium to be coated, employing the production method of the present invention, varies depending on the types of liquid coating compositions, concentration, amount of solvents, and drying capacity, none of which may be specified.

However, the coating rate is preferably 50-500 m/minute, but is more preferably 100-300 m/minute.

In cases in which coating is performed on the medium to be coated which incorporates a support having thereon at least one constituting layer, employing the production method of the present invention, the above coating commonly starts after falling-rate drying of the constituting layer formed on the support, but starts preferably after the drying completion point. Further, it is preferable that the above coating process, which results in the coating of the above constituting layer employing slide bead coating, and the coating processes which are performed employing the slot nozzle spray device of the present invention, are successively performed in the same production line (called on-line coating). The coating method according to the present invention makes it possible to achieve coating by employing a relatively small amount of a liquid coating composition. As a result, even when coating is performed in the state in which the above constituting layer is not completely dried, the resulting drying load is minimal and also results in minimal adverse effects to the above constituting layer. Further, it was unexpectedly discovered that when the coating according to the present invention is performed prior to complete drying of the above constituting layer, it was possible to minimize cracking of the constituting layer.

It is possible to use the production method of the present invention in the drying process of the above constituting layer due to lower drying load. It is preferable that in the drying process, while continuously conveying a coating in a wet state, drying is performed by blowing drying air, controlled at the specified temperature and humidity conditions, onto the surface or the reverse of the coating.

The drying process of a coating in a wet state is mainly classified as follows. Initial drying is called the constant-rate drying zone. In this zone, water, used as a solvent, and other solvents are evaporated while taking a latent heat of vaporization, whereby the surface temperature of the constituting layer remains nearly constant. The period in which the temperature is kept constant is called the constant-rate drying zone. After the constant-rate drying zone, in order to further evaporate water and solvents, which exhibit interaction with solutes of the liquid coating composition, other than the heat of vaporization, energy is required to overcome this interaction, whereby the surface temperature increases. This period is called the falling-rate drying zone. Falling-rate drying, as described herein, refers to a phenomenon in which evaporation of solvents from the surface exceeds the moisture transfer in the coating within the layer. Subsequently, when the falling-rate drying is completed, a zone starts in which the temperature of the drying air and the surface temperature of ink-jet recording sheet are equalized. This is called the drying end point.

The methods for confirming the constant-rate drying zone, the falling-rate drying zone, and the drying end point, as described above, are not particularly limited. For example, surface temperature is monitored, whereby each of the zones is determined. When the surface temperature is constant, drying is in the constant-rate drying zone, and when the temperature increases, drying is in the falling-rate drying zone, while when the surface temperature is the same as the drying temperature, drying has reached the end point.

Further, as another method, a moisture meter is arranged in each zone, and the moisture content of the coating is monitored, whereby it is possible to specify the drying end point by noting the zone in which the decreasing curve of the moisture content flattens.

EXAMPLES

The present invention will now be described with reference to examples, however the present invention is not limited thereto.

<<Preparation of Recording sheet>>

(Preparation of Medium to be Coated)

(Preparation of Support)

Highly fluid slurries in the form of liquid were prepared in such a manner that to 100 parts by weight of wood pulp (LBKP/NBSP=50/50) added were one part by weight of polyacrylamide, four parts by weight of ash (talc), two parts by weight of cation starch, 0.5 part by weight of polyamidoepichlorohydrin, and alkylketene dimers (sizing agents) in varying addition amounts. Subsequently, base paper was prepared to reach a basis weight of 170 g/m$^2$, employing a Fourdrinier paper machine. After calendering, low density polyethylene resins, at a density of 0.92 incorporating 7 percent by weight of anatase type titanium oxide and tone controlling agents in a small amount, were applied at 320° C. onto one side of the resulting base paper to reach a thickness of 32 μm, employing a melt extrusion coating method. Thereafter, a mixture of high density polyethylene at a density of 0.96/low density polyethylene at a density of 0.92=70/30 was melted and applied onto the other side also to reach a thickness of 32 μm, employing the same melt extrusion method.

Glossiness of 60 degrees and center line mean roughness Ra, of the side onto which an ink absorptive layer is applied, was 56 percent and 0.12 μm, respectively.

The titanium oxide-containing side of the above support was subjected to corona discharge and subsequently, gelatin in an amount of 0.05 g/m$^2$ was applied to form a sublayer.

On the other hand, a styrene/acryl based emulsion incorporating minute silica particles (being a matting agent) at an average particle diameter of 1.0 μm and a cationic polymer (being an electrically conductive agent) in a small amount was applied onto the other side to reach a dried coating thickness of approximately 0.5 μm, whereby a support, onto which an ink absorptive layer is applied, was prepared.

The glossiness, center line mean roughness Ra, and Bekk smoothness of the rear surface were approximately 18 percent, approximately 4.5 μm, and 160-200 seconds, respectively.

The moisture content of the base paper of the support, prepared as above, was 7.0-7.2 percent.

Further, the opacity of the support was 96.5 percent, while the whiteness of the same was L*=95.2, a*=0.56, and b*=−4.35.

(Preparation of Ink Absorptive Layer Liquid Coating Composition)

The ink absorptive layer liquid coating composition, composed as described below, was prepared based on the following steps.

<Preparation of Titanium Oxide Dispersion 1>

Added to 90 L of an aqueous solution at a pH of 7.5 incorporating 150 g of sodium tripolyphosphate, 500 g of polyvinyl alcohol (PVA235, produced by Kuraray Co., Ltd.), 150 g of. Cation Polymer (P-1), and 10 g of antifoamer SN381 available from San Nobuko Co., Ltd., was 20 kg of titanium oxide at an average particle diameter of approximately 0.25 μm (W-10, produced by Ishihara Sangyo Co., Ltd.). The resulting mixture was dispersed employing a high pressure homogenizer (produced by Sanwa Industry Co., Ltd.), and the total volume was made to 100 L, whereby uniformly dispersed Titanium Oxide Dispersion 1 was prepared. Cationic Polymer (P-1)

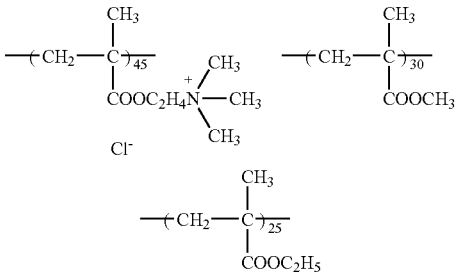

<Preparation of Silica Dispersion 1>

| | |
|---|---|
| Water | 71 L |
| Boric acid | 0.27 kg |
| Borax | 0.24 kg |
| Ethanol | 2.2 L |
| 25% aqueous Cationic Polymer (P-1) solution | 17 L |
| 10% aqueous Anti-discoloring Agent (AF1 *1) | 8.5 L |
| Aqueous optical brightening agent solution (*2) | 0.1 L |
| Pure water to make | 100 L |

(*1): Anti-discoloring Agent (AF-1) $HO—N(C_2H_4SO_3Na)_2$
(*2): UVITEX NFW LIQUID, produced by Ciba Specialty Chemicals Co.

Prepared as inorganic microparticle was 50 kg of gas phase method silica (at an average primary particle diameter of approximately 12 nm). The above additives were then added and the resulting mixture was dispersed employing the method described in JP-A No. 2002-47454, whereby Silica Dispersion 1 was prepared.

<Preparation of Silica Dispersion 2>

Silica Dispersion 2 was prepared in the same manner as above Silica Dispersion 1, except that Cationic Polymer (P-1) was replaced with Cationic Polymer (P-2).

Cationic Polymer (P-2)

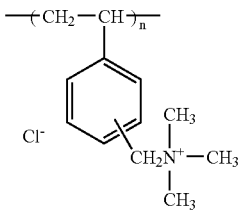

<Preparation of Ink Absorptive Layer Liquid Coating Composition>

Each of the first, second, third, and fourth ink absorptive layer liquid coating compositions was prepared based on the following steps.

| <First Layer Liquid Coating Composition> While stirring at 40° C., successively mixed with 610 ml of Silica Dispersion 1 were the following additives: | |
|---|---|
| 5% aqueous polyvinyl alcohol (PVA235, produced by Kuraray Industry Co., Ltd.) | 220 ml |

-continued

| | |
|---|---|
| 5% aqueous polyvinyl alcohol (PVA245, produced by Kuraray Industry Co., Ltd.) | 80 ml |
| Titanium oxide dispersion | 30 ml |
| Polybutadiene dispersion (at an average particle diameter of approximately 0.5 μm and 40% solids) | 15 ml |
| 5% aqueous Surface Active Agent (SF1) solution | 1.5 ml |
| Water to make | 1000 ml |
| <Second Layer Liquid Coating Composition> While stirring at 40° C., successively mixed with 630 ml of Silica Dispersion 1 were the following additives: | |
| 5% aqueous polyvinyl alcohol (PVA235, produced by Kuraray Industry Co., Ltd.) | 180 ml |
| 5% aqueous polyvinyl alcohol (PVA245, produced by Kuraray Industry Co., Ltd.) | 80 ml |
| Polybutadiene dispersion (at an average particle diameter of approximately 0.5 μm and 40% solids) | 15 ml |
| Pure water to make | 1000 ml |
| <Third Layer Liquid Coating Composition> While stirring at 40° C., successively mixed with 650 ml of Silica Dispersion 2 were the following additives: | |
| 5% aqueous polyvinyl alcohol (PVA235, produced by Kuraray Industry Co., Ltd.) | 180 ml |
| 5% aqueous polyvinyl alcohol (PVA245, produced by Kuraray Industry Co., Ltd.) | 80 ml |
| Pure water to make | 1000 ml |
| <Fourth Layer Liquid Coating Composition> While stirring at 40° C., successively mixed with 650 ml of Silica Dispersion 1 were the following additives. | |
| 5% aqueous polyvinyl alcohol (PVA235, produced by Kuraray Industry Co., Ltd.) | 180 ml |
| 5% aqueous polyvinyl alcohol (PVA245, produced by Kuraray Industry Co., Ltd.) | 80 ml |
| 50% aqueous saponin solution | 4 ml |
| 5% aqueous Surface Active Agent (SF1) | 6 ml |
| Water to make | 1000 ml |
| Surface Active Agent (SF1) | |

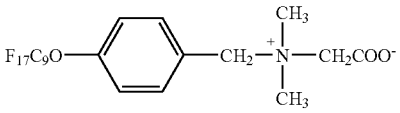

Each of the liquid coating compositions, prepared as above, was subjected to two-stage filtration employing a filter capable of collecting particles of at least 20 μm.

Each of the above liquid coating compositions exhibited viscosity characteristics such as 30-80 mPa·s at 40° C., and 30,000-100,000 mPa·s at 15° C.

(Formation of Ink Absorptive Layer)

Each of the liquid coating compositions, prepared as above, was simultaneously applied onto the surface of a support coated with polyolefin on both sides, prepared as above, in the order of the first layer (35 μm), the second layer (45 μm), the third layer (45 μm), and the fourth layer (40 μm). Incidentally, the numerical value in the parenthesis represents each wet coating thickness. Simultaneous coating was performed at a coating width of approximately 1.5 m and a coating rate of 200 m/minute, employing a 4-layer type curtain coater.

Immediately after coating, the resulting coating was cooled for 12 seconds in a cooling zone maintained at 8° C., and was then dried by blowing air at 20-30° C. and a maximum relative humidity of 18 percent for 18 seconds; at 60° C. and a maximum relative humidity of 20 percent for 72 seconds; and at 55° C. and a maximum relative humidity of 20 percent for 36 seconds. The layer temperature in the constant-rate drying zone was 8-30° C., while in the falling-rate drying zone, the layer temperature was gradually increased. Thereafter, the resulting coating was rehumidified in a rehumidifying zone at 23° C. and a relative humidity of 40-60 percent and wound in a roll, whereby a medium to he coated was prepared.

(Preparation of Sample 101)

(Preparation and Coating of Water-based Coating Composition B)

An aqueous solution incorporating 0.10 percent by weight of the water-soluble dye described below, was prepared, which was designated as Overcoat Solution 1. The viscosity of above Overcoat Solution 1 was 1.0 mPa·s at room temperature, while the dynamic surface tension (DST) and the static surface tension (SST) of the same also at room temperature were 70 mN/m and 71 mN/m, respectively.

Further, the dynamic surface tension (DST) was determined as follows. At a coating temperature of 25° C., BP2, produced by Kruss Co. was employed. Bubbles were continually generated and surface tension values during 50 ms were determined employing a bubble pressure method. Further, the static surface tension (SST) was determined as follows. At a coating temperature of 25° C., surface tension was determined based on a platinum plate method, employing a surface tensiometer (CBVP-Z, manufactured by Kyowa Interface Science Co., Ltd.).

Water-Soluble Dye

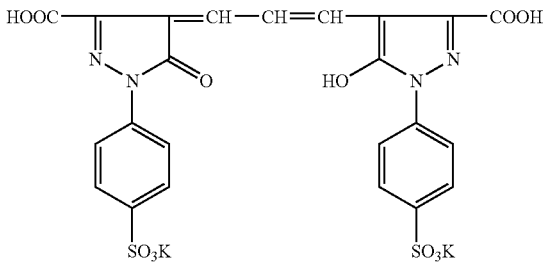

(Overcoat)

By employing the slot nozzle spray device structured as shown in FIG. 5, above Overcoat Solution 1 was coated.

The slot nozzle spray device employed for coating was structured as follows. Angle α formed by basal planes 2*c* and 2*d* of the external die blocks was controlled to be 180 degrees, while angle β formed between the liquid coating composition ejecting exit of the liquid coating composition and the gas ejecting exit of the gas nozzle was controlled to be 30 degrees, while each of widths L3 and L4 of the basal planes of the external die blocks was controlled to be 40 mm, and further the distance between the basal plane of the external die block and the surface of the medium to be coated was controlled to be 20 mm. Each of the nozzle shapes was the same as FIG. 7 and the aperture end of the liquid coating composition nozzle was a square of 150 μm per side. The pitch was controlled to be 500 μm, and the gas nozzle was shaped into a 150 μm wide slit. Further, at initiation of coating, air was fed at a rate of 200 m/second from the gas nozzle and Overcoat Solution 1 was fed from the solution nozzle, whereby coating was initiated.

In the coating line shown in FIG. 9 (the latter half of the overcoat zone shown in FIG. 9 was used, and the coater was arranged at the drying end point of the ink absorptive layer), Overcoat Solution 1, prepared as above, was applied onto the medium to be coated, prepared as above, to reach a coating rate of 200 m/minute and a wet coating thickness of 11.5 mm, employing the slot nozzle spray device structured as shown in FIGS. 2 and 5.

(Preparation of Sample 102)

Sample 102 was prepared in the same manner as above Sample 101, except that Overcoat Solution 1 was replaced with Overcoat Solution 2, which was prepared in such a manner that OLFIN E1010 (the compound represented by General Formula (2), at an ethylene oxide addition molar number N (m+n)=10, produced by Nissin Chemical Industry Co., Ltd.), which is a acetylene glycol based surface active agent according to the present invention was added to Overcoat Solution 1 to reach a concentration of 0.01 percent. DST and SST of Overcoat Solution 2 were 60 mN/m and 50 mN/m, respectively.

OLFIN E1010

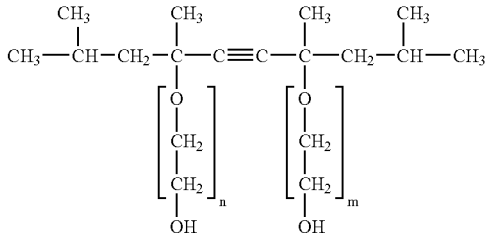

(Preparation of Samples 103-105)

Samples 103-105 were prepared in the same manner as above Sample 102, except that as listed in Table 1, the amount of OLFIN E1010 added to Overcoat Solution 2 was varied, and DST and SST of the resulting Overcoat Solution were also varied.

(Preparation of Sample 106)

Sample 106 was prepared in the same manner as above Sample 102, except that as listed in Table 1, the surface active agent added to the Overcoat Solution was replaced with Surface Active Agent A below, and DST and SST of the resulting Overcoat Solution were also varied.

Surface Active Agent A

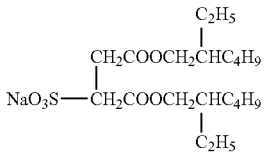

<<Evaluation of Recording Sheet>>

Each of the recording sheet, prepared as above, was subjected to each of the evaluations based on the following methods.

(Evaluating of Streaking Resistance)

The surface of the overcoat, which was applied onto each of the recording sheet and subsequently dried, was visually observed and streaking resistance was evaluated based on the following evaluation criteria.

A: no streaking was noted on the coating surface

B: slight streaking was noted on the coating surface, but was commercially viable C: relatively severe streaking was noted on the coating surface, which resulted in problems for commercial viability D: marked streaking was noted on the coating surface Incidentally, "streaking", as described in the present invention, refers to non-uniform density due to coating streaks which result in variation of density across the coating width of the coating surface.

(Evaluation of Uneven Density Resistance: Determination of RMS)

The surface density of each of the recording sheet coated with an overcoat was determined employing a scanner (ES-8000, produced by Epson Co.), and as an index to evaluate coating mottle, RMS was obtained based on Formula (1) below, utilizing determined density values. RMS represents quantitative values of the coating mottle based on the squared average of density difference at each point with respect to the average density. As the coating mottle decreases, RMS values also decrease. In the present invention, depending on the correlation between the calculated RMS values and visual evaluation, the case of an RMS value of 4 or less was judged to be commercially viable.

$$\mathrm{RMS} = \left(\sum_{0}^{n}((Xi - X)^2)/n\right)^{1/2} \times 50/X \qquad \text{Formula (1)}$$

wherein Xi represents the measured density value, X represents the average value of the measured density, and n represents the number of measured locations.

(Evaluation of Edge Portion Coatability)

The entire surface density of each of the recording sheet coated with an overcoat was determined across the width, employing a scanner (ES-8000, produced by Epson Co.), and distance L from both edges (being edge portions) of coating at measured points Z at which the density exceeded 90 percent of the average density.

A: the distance of measured point Z from the edge portion was at most 5 mm, resulting in no problems for commercial viability B: the distance of measured point Z from the edge portion was 5-10 mm, resulting in no problems for commercial viability C: the distance of measured point Z from the edge portion was 10-20 mm, and was within the commercially viable range D: the distance of measured point Z from the edge portion was at least 20 mm, resulting in problems for commercial viability

TABLE 1

| | Surface Active Agent | | Characteristics of Water-based coating composition B | | | Coating | Evaluation Results of Coatability | | | |
|---|---|---|---|---|---|---|---|---|---|---|
| Sample No. | Type | Concentration (%) | Viscosity (mPa · s) | DST (mN/m) | SST (mN/m) | Thickness (μm) | Streaking Resistance | Uneven Density Resistance (RMS) | Edge Portion Coatability | Remarks |
| 101 | — | — | 1.0 | 70 | 71 | 11.5 | D | 2.78 | D | Comp. |
| 102 | OLFIN E1010 | 0.01 | 1.0 | 60 | 50 | 11.5 | D | 2.54 | D | Comp. |
| 103 | OLFIN E1010 | 0.03 | 1.0 | 55 | 45 | 11.5 | B | 2.46 | C | Inv. |
| 104 | OLFIN E1010 | 0.05 | 1.0 | 50 | 42 | 11.5 | A | 2.27 | B | Inv. |
| 105 | OLFIN E1010 | 0.25 | 1.0 | 40 | 35 | 11.5 | A | 1.83 | A | Inv. |
| 106 | Surface Active Agent A | 0.02 | 1.0 | 60 | 32 | 11.5 | D | 2.61 | D | Comp. |

Comp.: Comparative Example
Inv.: Present Invention

As can clearly be seen from the results listed in Table 1, Sample 101, to which no surface active agent was added, resulted in problems of commercial viability with regard to streaking resistance, uneven density resistance, and edge coatability. Further, when the dynamic surface tension exceeded 55 mN/m, Samples 102 and 103, even though carrying a surface active agent, resulted in problems of commercial viability with regard to streaking resistance, uneven density resistance and edge coatability.

Contrary to these, Samples of the present invention, which incorporated the surface active agent to adjust the dynamic surface tension to at most 55 mN/m, resulted in improved effects for streaking resistance, uneven density resistance and edge coatability, compared to Comparative Samples. Of these, particularly, it is seen that DST is preferably at most 50 mN/m, but is more preferably at most 40 mN/m.

Example 2

<<Preparation of Recording Sheet>>

(Preparation of Samples 201-204)

Samples 201-204 were prepared in the same manner as Samples 101, 102, and 103 described in Example 1, except that the wet coating thickness of each of the Overcoat Solutions was varied to 8.0 μm.

(Preparation of Samples 205-208)

Samples 205-208 were prepared in the same manner as Samples 101, and 103-105 described in Example 1, except that each of the Overcoat Solutions was prepared by adding carboxymethyl cellulose so that the resulting viscosity reached 5 mPa·s.

(Preparation of Samples 209-212)

Samples 209-212 were prepared in the same manner as Samples 101, and 103-105 described in Example 1, except that each of the Overcoat Solutions was prepared by adding carboxymethyl cellulose so that the resulting viscosity reached 10 mPa·s.

<<Evaluation of Recording Sheet>>

Each of the recording sheet, prepared as above, was evaluated for streaking resistance, uneven density resistance (determination of RMS), and edge coatability, employing the same methods as in Example 1. Table 2 shows the results.

Example 3

<<Preparation of Recording Sheet>>

(Surface Water-Repellent Treatment of Slot Nozzle Spray Device)

A surface water-repellent finishing agent was prepared in such a manner that OPTOOL DSX (at a 20 percent solution, produced by Daikin Industries, Ltd.) was diluted with HFE71000 (produced by 3M Co.) to reach a concentration of 0.1 percent.

Subsequently, 0.1 percent OPTOOL DSX solution was uniformly applied onto basal planes 2*c* an and 2*d* of the external die blocks, the basal planes 3*c* and 3*d* of the internal die blocks, the wall surfaces of gas nozzles 2, and liquid coating composition nozzle 3 illustrated in FIG. 2, and subsequently dried at room temperature over 24 hours, whereby the lip portion of the slot nozzle spray was subjected to water-repellent finishing.

Subsequently, Sample 301 was prepared in the same manner as Sample 104 described in Example 1, except that

TABLE 2

| | Surface Active Agent | | Characteristics of Water-based coating composition B | | Coating | Evaluation Results of Coatability | | | |
|---|---|---|---|---|---|---|---|---|---|
| Sample No. | Type | Concentration (%) | Viscosity (mPa · s) | DST (mN/m) | Thickness (μm) | Streaking Resistance | Uneven Density Resistance (RMS) | Edge Portion Coatability | Remarks |
| 201 | — | — | 1.0 | 70 | 8.0 | D | 2.65 | D | Comp. |
| 202 | OLFIN E1010 | 0.03 | 1.0 | 55 | 8.0 | B | 2.21 | C | Inv. |
| 203 | OLFIN E1010 | 0.05 | 1.0 | 50 | 8.0 | B | 1.50 | B | Inv. |
| 204 | OLFIN E1010 | 0.25 | 1.0 | 40 | 8.0 | A | 1.34 | A | Inv. |
| 205 | — | — | 5.0 | 70 | 11.5 | D | 3.34 | C | Comp. |
| 206 | OLFIN E1010 | 0.03 | 5.0 | 55 | 11.5 | B | 3.21 | B | Inv. |
| 207 | OLFIN E1010 | 0.05 | 5.0 | 50 | 11.5 | B | 2.78 | A | Inv. |
| 208 | OLFIN E1010 | 0.25 | 5.0 | 40 | 11.5 | A | 2.66 | A | Inv. |
| 209 | — | — | 10.0 | 70 | 11.5 | D | 3.76 | B | Comp. |
| 210 | OLFIN E1010 | 0.03 | 10.0 | 55 | 11.5 | C | 3.67 | B | Inv. |
| 211 | OLFIN E1010 | 0.05 | 10.0 | 50 | 11.5 | B | 2.89 | A | Inv. |
| 212 | OLFIN E1010 | 0.25 | 10.0 | 40 | 11.5 | B | 2.78 | A | Inv. |

Comp.: Comparative Example
Inv.: Present Invention

As can clearly be seen from the results of Table 2, Samples 202-204 of the present invention resulted in desired effects for the variation of the wet coating thickness of the Overcoat Solution. Further, even in the case of changing the viscosity of the Overcoat Solution, it is seen that Samples 206-208 as well as Samples 210-213 resulted in desired effects for each characteristic, compared to Comparative Examples, and the coatability resulted in no problems of commercial viability. Further, it is seen that by particularly decreasing the DST of the Overcoat Solution to 50 mN/m or less, preferable coatability was obtained, irrespective of the viscosity of the Overcoat Solution.

employed as a slot nozzle spray device was one which was subjected to the above surface water-repellent finishing.

(Preparation of Sample 302)

Sample 302 was prepared in the same manner as above Sample 301, except that the surface water-repellent finishing agent solution was replaced with a solution prepared by mixing 20 parts by weight of SAITOP 105P (produced by Asahi Glass Co., Ltd.) with 80 parts by weight of CT-SOLV100 (also produced by Asahi Glass Co., Ltd.).

(Preparation of Samples 303 and 304)

Samples 303 and 304 were prepared in the same manner as above Sample 301, except that the surface water-repellent finishing of the slot nozzle spray device was replaced with each of TEFLON (a registered trade name) coating (ECTFE was used) and water-repellent plating (NIMURON produced by Uyemura & Co., Ltd.).

<<Evaluation of Recording Sheet>>

Each of the recording sheet, prepared as above, was evaluated for streaking resistance, uneven density resistance (determination of RMS), and edge portion coatability, employing the same methods as described in Example 1. Table 3 lists the results.

Each of the Samples prepared as above, was stored at 36° C. for three days.

<<Evaluation of Recording Sheet>>

Each of the recording sheet prepared as above, was evaluated for each item above, employing the methods below.

(Evaluation of Cracking Resistance)

The number of cracks per 0.3 $m^2$ on the surface of each of the recording sheet coated with the overcoat was visually counted.

TABLE 3

| Sample No. | Surface Active Agent Type | Surface Active Agent Concentration (%) | Water-repellent finishing of Slot Nozzle Spray Device | Coating Rate (m/min) | Coating Thickness (μm) | Coatability Evaluation Results: Streaking Resistance | Coatability Evaluation Results: Uneven Density Resistance (RMS) | Coatability Evaluation Results: Edge Portion Coatability | Remarks |
|---|---|---|---|---|---|---|---|---|---|
| 104 | OLFIN E1010 | 0.05 | — | 200 | 11.5 | A | 2.27 | B | Inv. |
| 301 | OLFIN E1010 | 0.05 | OPTOOL DSX | 200 | 11.5 | A | 1.86 | A | Inv. |
| 302 | OLFIN E1010 | 0.05 | SAITOP 105 | 200 | 11.5 | A | 1.82 | A | Inv. |
| 303 | OLFIN E1010 | 0.05 | TEFLON (*) coating | 200 | 11.5 | A | 1.78 | A | Inv. |
| 304 | OLFIN E1010 | 0.05 | water-repellent plating | 200 | 11.5 | A | 1.97 | A | Inv. |

(*) TEFLON: registered trade name, Du Pont Co.
Inv.: Present Invention

As can clearly be seen from the results listed in Table 3, Samples 301-304 which were prepared employing the slot nozzle spray device, which was subjected to surface water-repellent finishing, resulted in further enhancement of each of the characteristics.

Example 4

<<Preparation of Recording Sheet>>

(Preparation of Sample 401)

Sample 401 was prepared in the same manner as Sample 101 described in Example 1, except that the water-soluble dye added to Overcoat Solution 1 was omitted.

(Preparation of Samples 402-405)

Samples 402-405 were prepared in the same manner as above Sample 401, except that as listed in Table 4, DST was controlled by varying the types and added amounts of surface active agents added to the Overcoat Solution, as well as the coated amount of the same.

(Preparation of Samples 406-409)

Samples 406-409 were prepared in the same manner as Example 1, except that in the preparation of the medium to be coated, coating was performed in such a manner that a surface active agent was added to the fourth layer liquid coating composition of the ink absorptive layer so that the coated amount (mg/$m^2$) of the surface active agent was the same as each of Samples 402-405.

(Determination of Glossiness)

Secular glossiness of 75 degrees of the surface of each of the recording sheet coated with an overcoat was determined employing a variable angle photometer (VGS-101DP), produced by Nippon Denshoku Industries Co., Ltd.

(Evaluation of Print Quality)

(Evaluation of Uneven Density Resistance: Determination of RMS)

A solid blue image was printed to cover an entire sheet, employing ink-jet printer PM950C, produced by Seiko Epson Corp., and the resulting image density was recorded employing a scanner (ES-8000, produced by Epson Co.). Subsequently, determined density values were applied to aforesaid Formula (1), and RMS was calculated as an index to evaluate the coating mottle. RMS represents quantitative values of the coating mottle based on the squared average of density difference at each point with respect to the average density. As the coating mottle decreases, RMS values also decrease.

(Evaluation of Bronzing Resistance)

At 25° C. and relative humidity of 80 percent, a solid blue image was printed employing an ink-jet printer PM9650C, produced by Seiko Epson Corp. After storing the resulting image at 25° C. and relative humidity of 80 percent for 24 hours, the printed image was visually observed for bronzing, and bronzing generation was evaluated based on the criteria below.

A: no bronzing was noted

B: slight bronzing was noted, but resulted in no problems of commercial viability C: partial bronzing was noticed, but resulted in no problems of commercial viability D: significant bronzing occurred and the image was Commercially unviable Table 4 shows the results.

TABLE 4

| | Surface Active Agent | | | Characteristics of Water-based coating composition B | | | | | Print Quality | | |
|---|---|---|---|---|---|---|---|---|---|---|---|
| | | | Coated | | | | | | Uneven | | |
| Sample No. | Type | Added Layer | Weight ($mg/m^2$) | Viscosity (mPa · s) | DST (mN/m) | SST (mN/m) | Cracking Resistance | Glossiness | Density Resistance | Bronzing Resistance | Remarks |
| 401 | — | | — | 1.0 | 71 | 72 | 0 | 33 | 2.65 | A | Comp. |
| 402 | OLFIN E1010 | *1 | 5.8 | 1.0 | 50 | 42 | 0 | 35 | 1.86 | A | Inv. |
| 403 | OLFIN E1010 | *1 | 28.8 | 1.0 | 40 | 35 | 0 | 35 | 1.56 | A | Inv. |
| 404 | Surface Active Agent A | *1 | 4.0 | 1.0 | 50 | 28 | 0 | 34 | 2.36 | B | Comp. |
| 405 | Surface Active Agent A | *1 | 5.8 | 1.0 | 40 | 24 | 0 | 35 | 2.45 | B | Comp. |
| 406 | OLFIN E1010 | *2 | 5.8 | — | — | — | 8 | 25 | 1.93 | A | Comp. |
| 407 | OLFIN E1010 | *2 | 28.8 | — | — | — | 26 | 17 | 2.04 | B | Comp. |
| 408 | Surface Active Agent A | *2 | 4.0 | — | — | — | 15 | 23 | 2.65 | D | Comp. |
| 409 | Surface Active Agent A | *2 | 5.8 | — | — | — | 22 | 19 | 2.76 | D | Comp. |

*1: Water-based coating composition B

*2: Ink Absorptive Layer

Comp.: Comparative Example

Inv.: Present Invention

As can clearly be seen from the results listed in Table 4, Samples 406-409, which were prepared by incorporating surface active agents into the ink absorptive layer, resulted in decreased cracking resistance and glossiness, along with an increase in the addition amount of the surface active agent. On the other hand, it is seen that Samples 402-405, which were prepared in such a manner that the surface active agent was added to the overcoat liquid coating composition, and then the dynamic surface tension was controlled to at most 55 mN/m, exhibited desired cracking resistance and glossiness, as well as resulted in no problems of print quality. Further, it is seen that Samples 402 and 403, in which an acetylene glycol type surface active agent of the present invention was employed, exhibited excellent performance irrespective of the added amounts of the surface active agent.

Example 5

In the coating methods described in Examples 1-4, coating was similarly performed employing the Overcoat Solution which incorporated each of the hydrophilic binder cross-linking agent, image stabilizer, and water-soluble multivalent metal compounds as a function-providing compound, instead of the aqueous dye solution, and the coatability and the image performance were evaluated. As a result, it was possible to confirm the same results described in Example 1-4, the production method of the present invention in which the Overcoat Solution which satisfied the conditions specified by the present invention was applied onto a support, employing the slot nozzle spray device, resulting in desired streaking resistance, uneven density resistance (determined by RMS), and edge coatability to provide stable and desired image performance.

What is claimed is:

1. A method of producing an ink-jet recording sheet comprising the steps of:

(a) coating a water-based coating composition A to form a layer on a non-absorptive support, the coating composition A containing a hydrophilic binder and inorganic microparticles having an average particle diameter of not less than 3 nm and not more than 30 nm, (b) drying the coated layer so as to form a porous ink absorptive layer, and (c) applying a water-based coating composition B on the porous ink absorptive layer across a direction perpendicular to a conveying direction of the non-absorptive support employing a slot nozzle spray device, the slot nozzle spray device having:

(i) a coating nozzle for supplying the water-based coating composition B; and (ii) a gas nozzle for ejecting a gas to an aperture end portion of the coating nozzle which supplies the water-based coating composition B, wherein the water-based coating composition B has a dynamic surface tension of 20 to 55 mN/in, and the water-based coating composition B contains an acetylene glycol compound or an acetylene alcohol compound.

2. The method of producing an ink-jet recording sheet of claim 1, wherein at least one of the group consisting of:

(i) an aperture surface of the slot nozzle spray device;

(ii) a gas channel wall of the gas nozzle of the slot spray nozzle device; and (iii) a coating composition channel wall of the coating nozzle of the slot spray nozzle device, is subjected to surface water-repellent finishing.

3. The method of producing an ink-jet recording sheet of claim 1, wherein the water-based coating composition B further contains a compound which is capable of changing a property of the ink absorptive layer, wherein the compound is selected from the group consisting of:

(i) a cross-linking agent of the hydrophilic binder;

(ii) an image stabilizer;

(iii) a water-soluble multivalent metal compound;

(iv) a mordant; and (v) a pH controlling agent.

* * * * *